US008432320B2

(12) United States Patent
Jagielski et al.

(10) Patent No.: US 8,432,320 B2
(45) Date of Patent: Apr. 30, 2013

(54) MOBILE TERMINAL WITH A MONOPOLE LIKE ANTENNA

(75) Inventors: Ole Jagielski, Frederikshavn (DK); Simon Svedsen, Aalborg Ost (DK)

(73) Assignee: Hewlett-Packard Development Company, L.P., Houston, TX (US)

( * ) Notice: Subject to any disclaimer, the term of this patent is extended or adjusted under 35 U.S.C. 154(b) by 623 days.

(21) Appl. No.: 12/296,335

(22) PCT Filed: Apr. 11, 2007

(86) PCT No.: PCT/EP2007/053506

§ 371 (c)(1),
(2), (4) Date: Jun. 16, 2010

(87) PCT Pub. No.: WO2007/118824

PCT Pub. Date: Oct. 25, 2007

(65) Prior Publication Data

US 2010/0245177 A1 Sep. 30, 2010

(30) Foreign Application Priority Data

Apr. 18, 2006 (EP) ..... 06112695

(51) Int. Cl.
*H01Q 9/00* (2006.01)
*H01Q 1/24* (2006.01)

(52) U.S. Cl.
USPC ..... 343/702; 343/700 MS; 343/749

(58) Field of Classification Search ..... 343/702, 343/700 MS, 749, 829, 833, 834, 846, 895
See application file for complete search history.

(56) References Cited

U.S. PATENT DOCUMENTS

| | | | | |
|---|---|---|---|---|
| 6,344,823 | B1 * | 2/2002 | Deng | 343/700 MS |
| 6,535,170 | B2 * | 3/2003 | Sawamura et al. | 343/702 |
| 6,897,814 | B2 * | 5/2005 | Iwai et al. | 343/702 |
| 7,215,289 | B2 * | 5/2007 | Harano | 343/702 |
| 7,750,857 | B2 * | 7/2010 | Kim | 343/702 |
| 2003/0013490 | A1 * | 1/2003 | Shoji et al. | 455/562 |
| 2010/0214180 | A1 * | 8/2010 | Krogerus | 343/702 |

* cited by examiner

*Primary Examiner* — Vibol Tan

(57) ABSTRACT

A mobile terminal comprising: a casing with at least one body which has electronic means; an antenna arrangement having at least one antenna element (14) provided on or within said body or on or within at least one of several bodies of said casing in a defined spatial relation to a conducting chassis part (12) of the body or the respective bodies allowing a high frequency interaction between the antenna arrangement and the conducting chassis part, said conducting chassis part being limited by a periphery of the conducting chassis part. Said antenna element has at least one arm (16*a*, 16*b*) which extends outwardly of said periphery along at least one chassis part edge for promoting said high frequency interaction or/and that said antenna arrangement has at least two arms (16*a*, 16*b*) of different length which are provided by the same or at least two different antenna elements and which extend in different or opposed directions along at least one chassis part edge, wherein a shorter arm (16*b*) has an effective electrical length shorter than a quarter wavelength at a resonance frequency within the or a particular predetermined frequency band and a longer arm (16*a*) has an effective electrical length longer than a quarter wavelength at said resonance frequency, to improve the band width of said frequency band.

18 Claims, 19 Drawing Sheets

Plot #1, Marker #1
(2.4; -86.7) Ω
at 469.8 MHz

Plot #1, Marker #2
(16.1; 46.8) Ω
at 610.0 MHz

Plot #1, Marker #3
(1190.1; 76.2) Ω
at 750.3 MHz

Plot #1, Marker #4
(10.8; 15.4) Ω
at 586.8 MHz

Plot #2, Marker #1
(3.7; -25.0) Ω
at 469.8 MHz

Plot #2, Marker #2
(8.2; 21.2) Ω
at 610.0 MHz

Plot #2, Marker #3
(19.4; 78.3) Ω
at 750.3 MHz

Plot #2, Marker #4
(8.7; 24.6) Ω
at 619.8 MHz

| Stage | 1 | 2 | 3 | 4 | 5 | 6 | 7 |
|---|---|---|---|---|---|---|---|
| Capacitance [pF] | 20,0 | 11,6 | 7,8 | 5,7 | 4,3 | 3,3 | 2,5 |

| Stage | 1 | 2 | 3 | 4 | 5 | 6 | 7 | 8 | 9 | 10 |
|---|---|---|---|---|---|---|---|---|---|---|
| Capacitance [pF] | 22 | 14,7 | 10,9 | 8,4 | 6,6 | 5,4 | 4,4 | 3,6 | 2,9 | 2,3 |

MOBILE TERMINAL WITH A MONOPOLE LIKE ANTENNA

The invention relates to a mobile terminal for at least one of receiving wireless transmissions from a transmitter and transmitting wireless transmissions to a receiver, in particular for use in a wireless telecommunication system or/and for receiving media broadcasts, for example at least one of DVB-H and DMB broadcasts. Such a mobile terminal or mobile unit generally comprises: a casing with at least one body which has electronic means, preferably including at least one element of the group consisting of a control element arrangement, at least one display element, a microphone, a speaker arrangement, electronic circuitry, high frequency circuitry and a storage battery, the control element arrangement and the display element, if provided, generally being accommodated in a respective surface of the body and the electronic circuitry, the high frequency circuitry and the storage battery, if provided, generally being arranged within the respective body; an antenna arrangement having at least one antenna element provided on or within said body or on or within at least one of several bodies of said casing in a defined spatial relation to a conducting chassis part of the body or the respective body allowing a high frequency interaction between the antenna arrangement and the conducting chassis part, said antenna arrangement together with associated high frequency circuitry, being adapted to at least one of receiving wireless transmissions and transmitting wireless transmissions in at least one predetermined frequency band, said or each conducting chassis part being limited by a periphery of the conducting chassis part formed by one chassis part edge or several chassis part edges. Preferably, said receiving wireless transmissions and transmitting wireless transmissions, respectively, is based on or contributed to by said high frequency interaction at least in one frequency band, in particular in at least one lower frequency band.

Particularly, the invention relates to a mobile terminal in form of a mobile telephone or more generally in the form of a small mobile unit, such as a handheld computer or a small mobile television set and may possibly have only one body as mentioned, which has a conducting chassis part, or may have a plurality of bodies, each having a respective conducting chassis part. In particular, said casing may comprise a first body and a second body, each body having a conducting chassis part and electronic means, the mobile terminal further comprising a relative movement mechanism linking the first body and the second body and allowing a relative movement between the two bodies at least between a first operational relative position and a second operational relative position and an electrical connection arrangement providing at least one of signal and data and control and high frequency and grounding lines between the two bodies. In particular, the mobile telephone or small mobile unit may be of the so-called clamshell type, wherein a relative movement mechanism comprises at least one hinge effective between the two bodies, allowing a swivelling or folding movement of the two bodies with respect to each other between a closed operational relative position in which two surfaces of the two bodies face and cover each other and an open operational relative position in which the two surfaces both are uncovered. However, also other relative movement mechanisms, such as a slider mechanism allowing a sliding movement between the two bodies are within the scope of the invention.

Concerning the mobile unit with a relative movement mechanism, in particular of the clamshell type it should be added that one or both of the two bodies, generally ony the flip part body, or, alternatively, only the main part body may be provided with an additional relative movement mechanism, e.g. providing a rotational movement around a longitudinal axis, so that e.g. a display may alternatively be located on the outside or inside of the closed mobile unit.

Generally, the chassis part of the body or the respective body may be formed by or may comprise a printed circuit board carrying electronic means as mentioned.

When designing antennas for frequencies where the wavelength in air is much larger than the maximum dimension of the mobile unit, it is common knowledge that radiation from the mobile unit and receiving radiation in the mobile unit is based on a close interaction between the antenna element and the conductive parts (referred to as the chassis) within the phone. It is also known that there is a close relationship between the dimensions of an antenna and the obtainable bandwidth.

When designing antennas for electrical small mobile units it is generally a necessity to utilize the chassis inside the mobile as radiating element, whereby the antenna acts like an electromagnetic transducer or coupler and the chassis as the radiating part. At low frequencies, like GSM 850 and GSM 900, a large part of the radiation will occur from the chassis, while at higher frequencies like GSM 1800, GSM 1900 and UMTS more radiation will occur from the antenna element itself.

Low frequencies in this sense are for example VHF- and UHF-frequencies allocated or suggested for digital media broadcasting, in particular digital video or multimedia broadcasting, such as according to the digital DVB-H broadcasting system or the DMB/DAB broadcasting system. In particular it is referred to the UHF-Band IV and UHF-Band V (474 MHZ to 862 MHZ) which are allocated DVB-H broadcasts.

So, the design of antennas for optimum bandwidth at low frequencies is limited to by how good the electromagnetic coupling between the antenna and the chassis of the mobile unit is, and how good the design is of the electric matching circuit. In addition, the overall size of the antenna and the chassis, together with the position of the antenna compared to the chassis is also a determining factor for the bandwidth.

Having the antenna located at the middle of the chassis, as shown in FIG. 2*a*, results in a bad electromagnetic coupling and thereby a reduced bandwidth. The electromagnetic coupling is increased the closer the antenna is to the edge of the chassis (FIG. 2*b*).

According to a first aspect it is an object of the invention to achieve a good electromagnetic coupling between the antenna arrangement and at least one conducting chassis part (chassis) of the mobile terminal for obtaining a relatively broad bandwidth performance.

This object is achieved by providing that said antenna element has at least one arm which extends outwardly of said periphery along at least one chassis part edge for promoting said high frequency interaction.

It has been found that the best electromagnetic coupling and accordingly a comparatively large bandwidth is achieved when the antenna element or at least a part thereof is located outside the chassis of FIG. 2*c*.

On basis of the invention, a good electromagnetic coupling between the antenna element and the chassis of the mobile unit (mobile terminal) can be achieved for frequencies with wavelength in air much larger than the maximum dimension of the mobile unit. The invention further allows a simple structure of the antenna element or antenna elements so that the overall dimensions of the mobile unit need not significantly be increased.

Within the scope of the invention is in particular a single resonance antenna. According to the invention it is possible to tune the impedance of the antenna by the antenna element(s) itself to achieve a good bandwidth performance. However, for optimal bandwidth performance it is generally advisable to use a simple matching circuit.

In short, the following advantages may be achieved on basis of the invention: an increased bandwidth of a single resonance antenna on an electrical small mobile unit, when compared to the wavelength in air of the receiving signal; an overall size of the mobile unit which is not significantly increased when the invention is implemented; an impedance tuning of the antenna can be done by the antenna element(s) itself or by using matching components; for increasing the bandwidth a simple matching circuit can be used; and the invention can be used in terminals of different type and structure, e.g. monoblock, slider and clamshell shaped mobile units.

For obtaining and tailoring a resonance which can be used for transmitting and receiving wireless transmissions, i.e. for obtaining the mentioned single resonance antenna, it is highly appropriate if the antenna arrangement has at least two arms of different lengths which extend in different or opposed directions outwardly of said periphery along at least one chassis part edge. These arms may be provided by the same antenna element or at least two different antenna elements. In particular, it is proposed that a shorter arm of said two arms has an effective electrical length shorter than a quarter wavelength at a resonance frequency within the or a particular predetermined frequency band and a longer arm of said two arms has an effective electrical length longer than a quarter wavelength at said resonance frequency, so that a high frequency resonance is obtained for at least one of receiving wireless transmissions and transmitting wireless transmissions within a resonance bandwidth associated to the high frequency resonance.

The arm shorter than a quarter wavelength at the resonance frequency will electrically be more capacitive and accordingly introduce a +90° phase shift of the currents flowing on the shorter arm, while the longer arm will be more inductive and accordingly introduce a −90° phase shift on the currents flowing on the longer arm, giving a total difference of 180°. This structure will be more capacitive the lower the frequency is and more inductive the higher the frequency is. The contributions of the capacitive and inductive part of the antenna element will be equal at the resonance frequency and the antenna arrangement, together with the conducting chassis part, will basically (approximately) behave like a dipole over a ground plane, with the imbalance between the two arms of the antenna element, however, adding an additional resonance compared to the resonance of the traditional dipole antenna over a ground plane. This additional resonance can be used advantageously for receiving and transmitting wireless transmissions, e.g. for receiving media (video or multimedia) broadcast. By appropriately choosing the lengths of the two arms and using an appropriate simple matching circuit, a relatively broad resonance can be achieved having relatively low mismatch losses.

The provision and tailoring of a high frequency resonance for at least one of receiving and transmitting wireless transmissions based on two antenna element arms can be used to advantage irrespective of the arrangement of the antenna element with respect to the periphery of the conducting chassis part, e.g. also when the antenna element or elements are arranged along the chassis, overlapping with or located over the conducting chassis part.

Accordingly, a second aspect of the invention provides a mobile terminal as identified in the introductory part of the specification, wherein the antenna arrangement has at least two arms of different length, which are provided by the same antenna element or at least two different antenna elements and which extend in different or opposed directions along at least one chassis part edge, wherein a shorter arm of said two arms has an effective electrical length shorter than a quarter wavelength at a resonance frequency within the or a particular predetermined frequency band and a longer arm of said two arms has an effective electrical length longer than a quarter wavelength at said resonance frequency, so that a high frequency resonance is obtained for at least one of receiving wireless transmissions and transmitting wireless transmissions within a resonance bandwidth associated to the high frequency resonance. For example, the antenna element may be close to the edge of the conducting chassis part, spatially overlapping with the conductive chassis part, as shown in FIG. 2*b*. Of course, for promoting the high frequency interaction for achieving good bandwidth performance, it is preferred that the two arms extend outwardly of said periphery along at least one chassis part edge.

As already indicated, said resonance bandwidth may define or may be located within said or at least one frequency band, in which said receiving wireless transmissions and transmitting wireless transmissions, respectively, are based on or substantially contributed to by said high frequency interaction. This is appropriate, for example, when a good bandwidth performance in a lower frequency range, for example a good bandwidth performance for receiving digital video or multimedia broadcast, is a primary objective.

However, alternatively, said resonance bandwidth may define or may be located within said or at least one frequency band higher than a frequency band in which said receiving wireless transmissions and transmitting wireless transmissions, respectively, are based on or substantially contributed to by said high frequency interaction. For example, on basis of this proposal, one may achieve a good bandwidth performance for mobile telephoning in higher frequencies such as GSM 1800, GSM 1900 and UMPS, and, if desired, also for mobile telephoning and reception of digital video or multimedia broadcasts in lower frequencies, such as GSM 850 and GSM 900 and DVB-H and DMB/DAB broadcasts, for the lower frequencies preferably on basis of an effective high frequency coupling between the antenna element or antenna elements on the one hand and the conducting chassis part or conducting chassis parts on the other hand.

According to a preferred embodiment said or at least one shorter arm and said or at least one longer arm are directly electrically connected with each other, preferably as sections of a common antenna element. This realization of the antenna arrangement is appropriate in particular in case that the antenna element or antenna elements and the conducting chassis part or conducting chassis parts are designed to provide a high frequency resonance with sufficient resonance bandwidth in a fixed frequency range, without need to shift the high frequency resonance in frequency to cover the respective frequency band. All necessary impedance tuning of the antenna arrangement can be done by the antenna element or antenna elements itself/themselves or/and by using a simple matching circuit.

According to another embodiment, said or at least one shorter arm and said or at least one longer arm are electrically connected with each other via at least one switching or tuning circuit, which is operable to frequency shift said high frequency resonance within said predetermined frequency band continuously or stepwise.

The background of this proposal is that to cover a whole system bandwidth like for example DVB-H, the resonance frequency of the antenna should be in the lower region of the frequency range in order to achieve good performance for all DVB-H channels. Such a low resonance frequency requires a relatively long antenna and consequently a relatively large (e.g. in the region of 135 mm×80 mm) chassis (i.e. all conductive parts in the device, except of the antenna). The basic idea with this invention is, according to a third aspect, to tune the resonance frequency e.g. close to the highest system frequency and reduce the antenna band width to only cover a small part of the system frequency range. The resonance frequency is then switched/tuned down step by step to cover the whole system bandwidth. Since the antenna only has to cover a small frequency range at the highest system frequency the length of the antenna and thereby the size of the chassis can be reduced. Simulations indicate that for DVB-H it is possible to reduce the size of the chassis to 100 mm×50 mm by switching/tuning the antenna for example in 8 to 10 stages.

Preferably, at least the shorter or the longer arm, preferably both the shorter and the longer arm, has/have associated a (respective) switching or tuning circuit connecting the arm with a common feeding point associated to the high frequency circuitry.

The switching or tuning circuit or switching or tuning circuits may comprise at least one of an inductor arrangement and a capacitor arrangement having a tunable or switchable effective inductance or capacity, wherein preferably at least two inductors are selectively connectable in a series connection by a switch arrangement or/and at least two capacitors are selectively connectable in a parallel connection by a switch arrangement or/and at least one capacitor has a tunable capacity.

Most appropriate, the switching or the tuning is achieved by changing the effective inductance or effective inductances of the switching or tuning circuit or switching or tuning circuits, which preferably is/are positioned at the beginning of a respective of the antenna element arms. The switching or tuning circuit electrically located at the beginning of the shorter arm of the antenna arrangement may be used to tune the resonance frequency down in frequency. The higher the effective inductance is, the lower the resonance will be. The switching or tuning circuit electrically located at the beginning of the longer arm of the antenna arrangement may be used to determine the standing wave ratio SWR of the resonance frequency and the antenna bandwidth. A good SWR can be achieved at the expense of antenna bandwidth.

Instead of tuning the resonance frequency down in frequency, it is also possible to tune the resonance up in frequency. To this end, the switching or tuning circuit or switching or tuning circuits can present an effective capacity. The higher the capacity will be, the higher the resonance will be. Preferably, the location of the resonance at a lower frequency within the frequency band for low or vanishing capacity of a tunable/switchable capacitor arrangement is achieved by corresponding impedance tuning and arm length tuning of the antenna arrangement itself. However, it is of course also possible to use in this respect an inductor arrangement of the switching or tuning circuit(s).

It has already been indicated that the mobile terminal may have only one body comprising one conducting chassis part. Such a mobile terminal may be denoted as mono-block mobile unit. The conducting chassis part will generally be formed by one or several printed circuit boards together with all other conducting parts of the mobile terminal of the body, respectively.

Further, as already indicated, the mobile terminal may be of the slider or clamshell type having two bodies movable with respect to each other, each body generally comprising a conducting chassis part.

Concerning the antenna arrangement and the realisation of the longer and shorter arm or arms, different realizations are appropriate. For example, said at least one arm or said at least two arms may have a width in a direction orthogonal to a surface of said conducting chassis part within the periphery thereof exceeding a thickness of said conducting chassis part and covering said chassis part edge in outward direction. The width of the arm or arms is relevant for the bandwidth: a wider antenna element will give the better bandwidth.

According to a further approach at least one pair of arms of said antenna element or two different antenna elements is provided, which extend outwardly of the periphery along said at least one chassis part edge, a first arm of said pair being displaced with respect to said conducting chassis part in a direction orthogonal to a surface of said conducting chassis part within the periphery thereof and a second arm being displaced with respect to said conducting chassis part and with respect said first arm in said direction orthogonal to a surface of said conducting chassis, so that the conducting chassis part is located between the first and second arm, or—in case that the first and second body are provided—being displaced with respect to the other conducting chassis part in a direction orthogonal to a surface of said other conducting chassis part within the periphery thereof. By selecting the distance between the two arms of the pair of arms, the bandwidth may be influenced. The at least one pair of arms can advantageously be realized on basis of a simple wire structure or on basis of simple wire structures.

To provide the high frequency resonance mentioned in the foregoing, at least one pair of shorter arms and at least one pair of longer arms can be provided. To this end, it is proposed that the shorter arms each have a respective electrical length shorter than a quarter wavelength at said resonance frequency, and the longer arms each have an effective electrical length longer than said quarter wavelength, so that the high frequency resonance is obtained. This realization of the antenna arrangement further allows to provide an additional high frequency resonance, if the pair of arms or respective pair of arms has different lengths.

In case that a first and a second body of the mobile terminal, e.g. of the clamshell type or the slider type are provided, only one of the two bodies may be provided with at least one antenna element. In this case it is, however, preferred that both of the two bodies are provided with at least one respective antenna element. In case of such a realization, it is preferred that in one of the operational relative positions of the two bodies the two conducting chassis parts are located side by side sandwich-like between the first and second arm and in another of said operational relative positions the two conducting chassis with a respective of the first and second arm are located apart.

The invention is further explained, illustrated and exemplified in the following on basis of the exemplary embodiments shown in the Figures.

FIG. 3 exemplifies different positions of an antenna element with respect to the chassis of a mobile terminal and different realizations of the antenna element concerning two antenna element arms according to preferred embodiments of the invention according to a second aspect.

Figure 4:
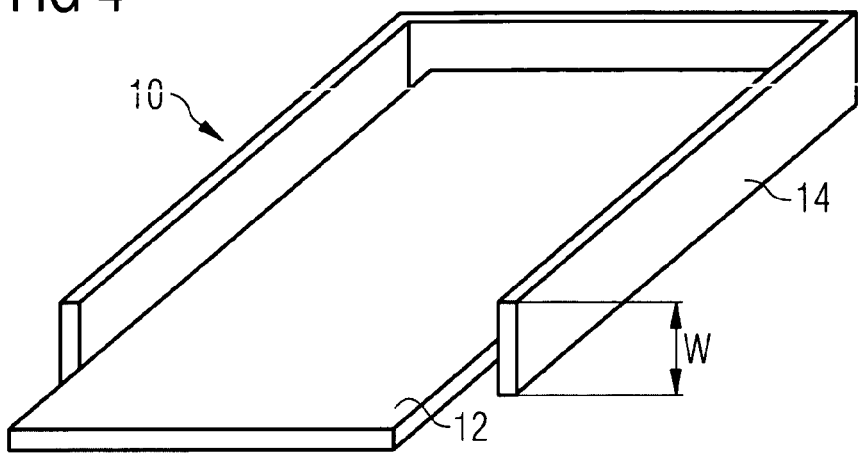

FIG. 4 shows a preferred realization and location with respect to the chassis of an antenna element in agreement with the invention.

Figure 5:
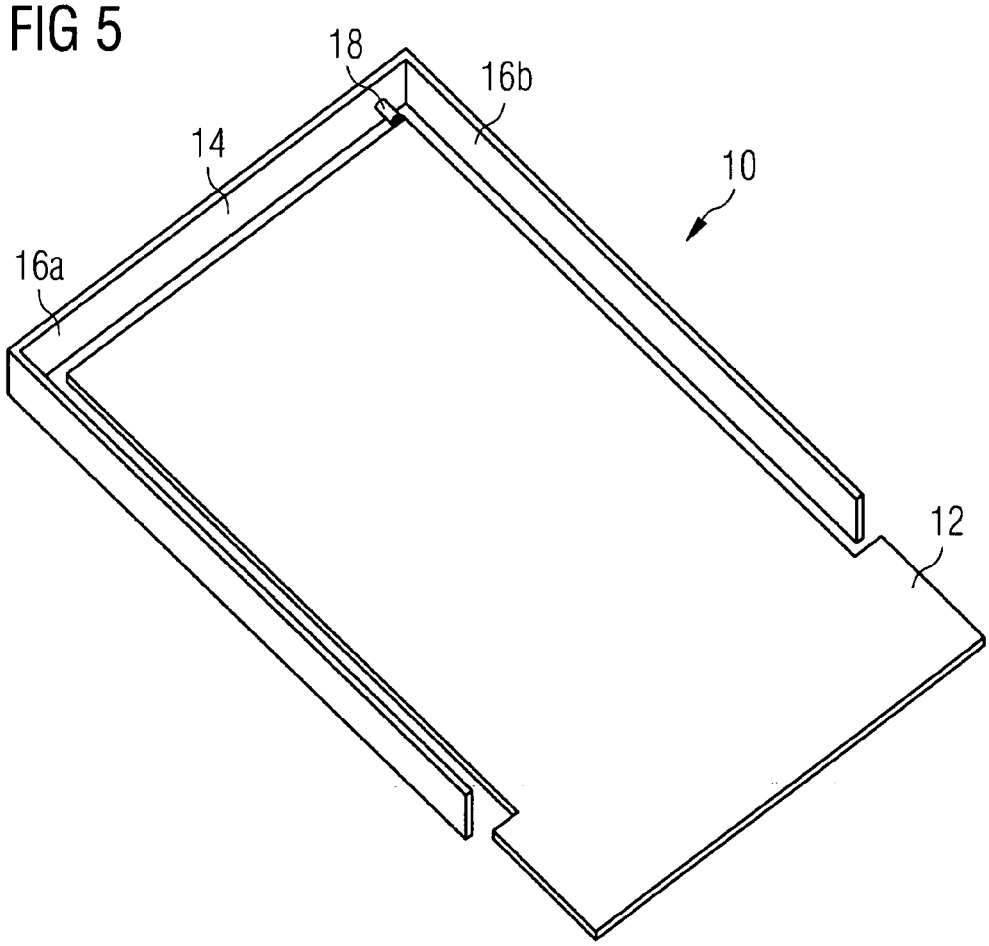

FIG. 5 illustrates an implementation of the invention in a monoblock mobile unit according to a first approach having a single solid antenna element.

Figure 6:
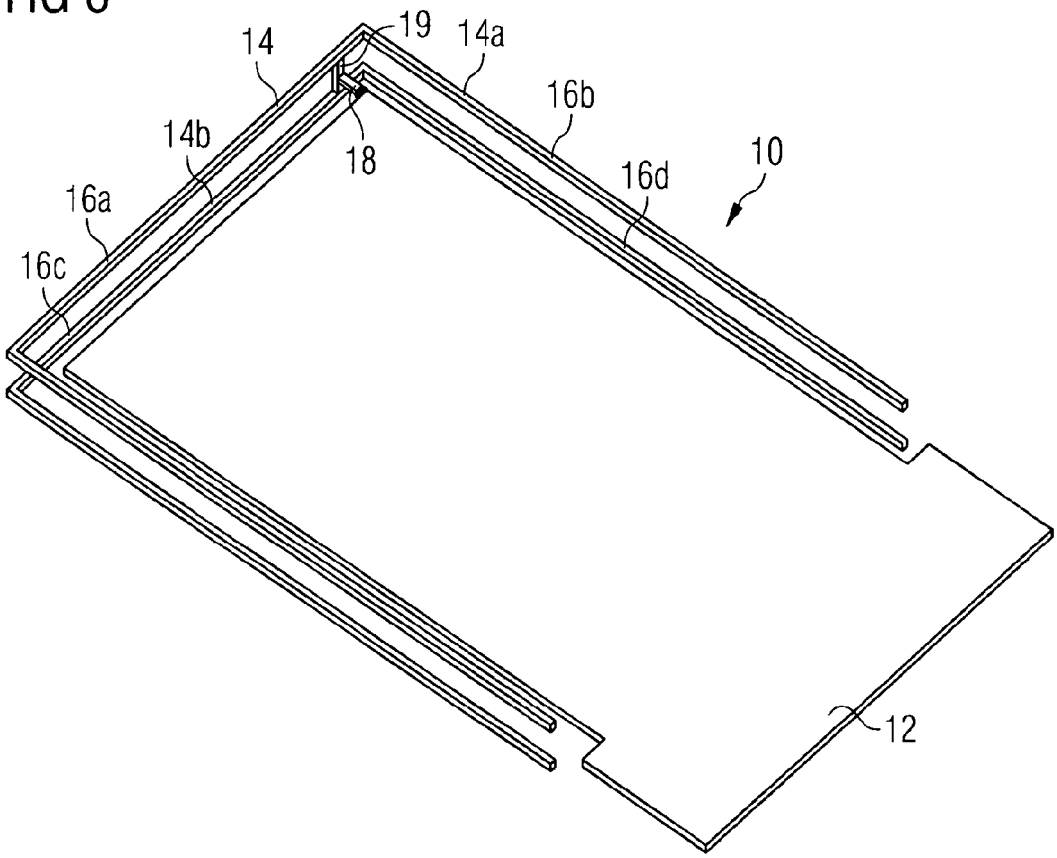

FIG. 6 illustrates an implementation of the invention in a monoblock mobile unit according to a second approach having a dual wire antenna element.

Figure 7:
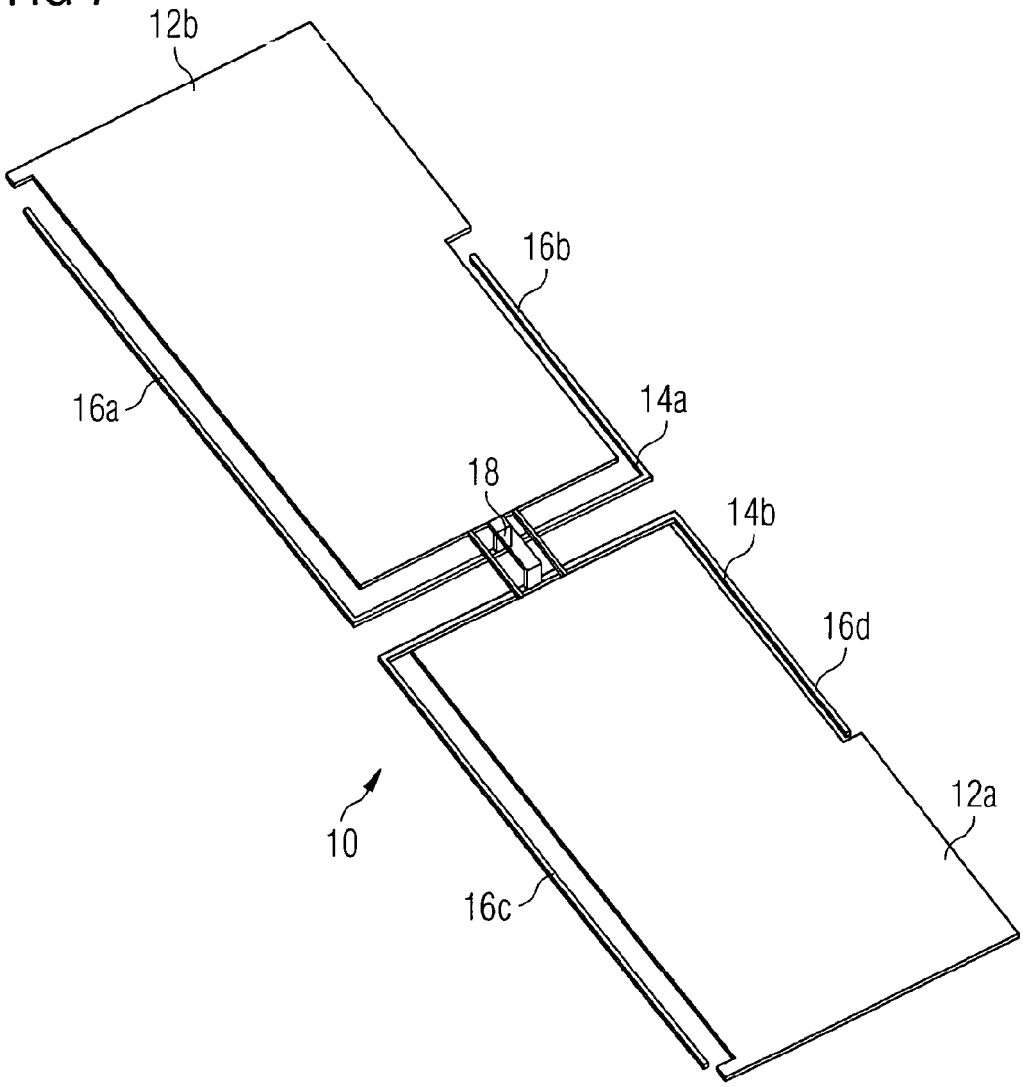

FIG. 7 illustrates an implementation of the invention in a camshell mobile unit having a dual wire element, with the mobile unit being shown in the open condition.

Figure 8:
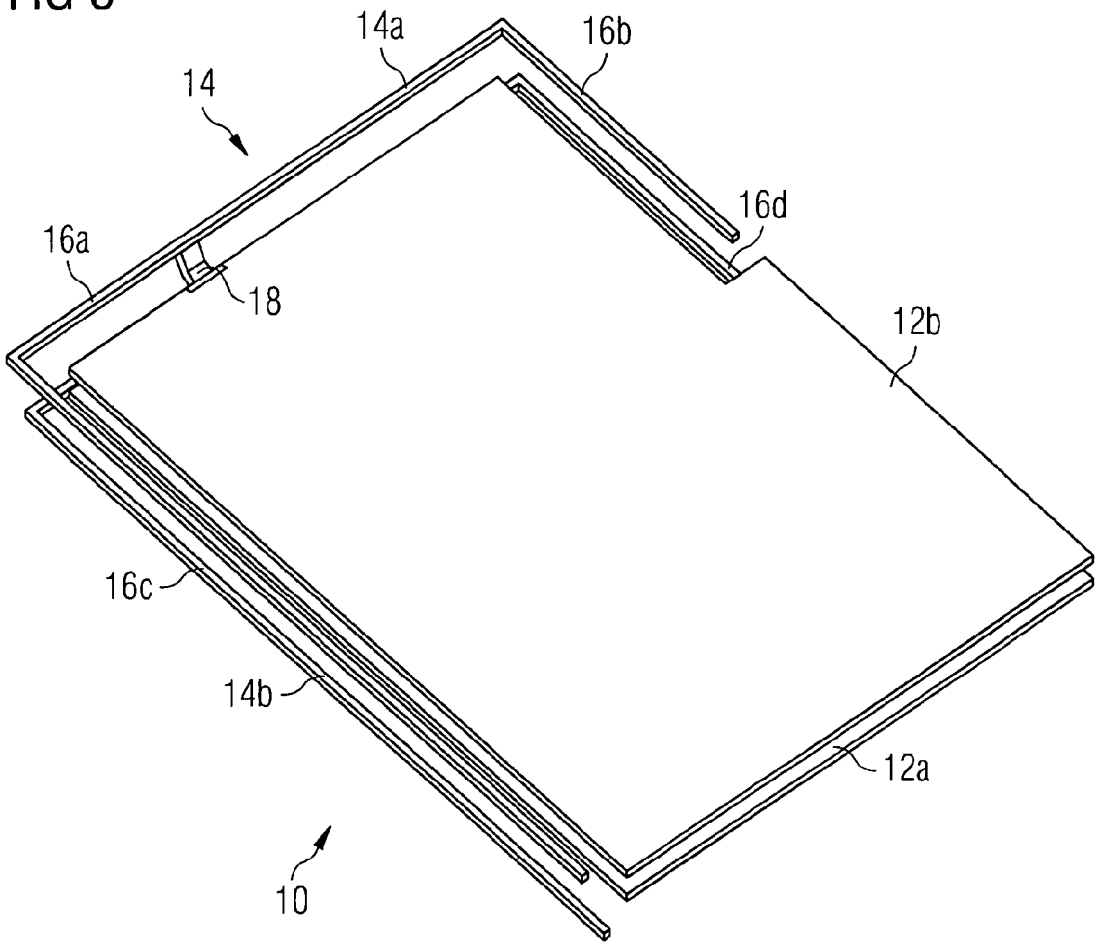

FIG. 8 shows the mobile unit of FIG. 7 in the closed condition.

Figure 9A:
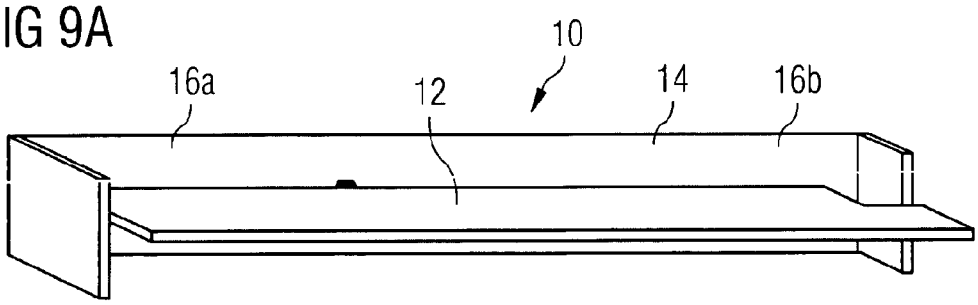
Figure 9B:
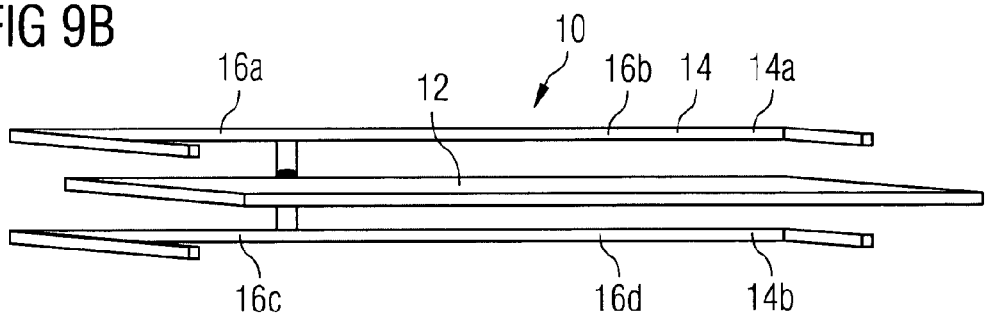
Figure 9C:
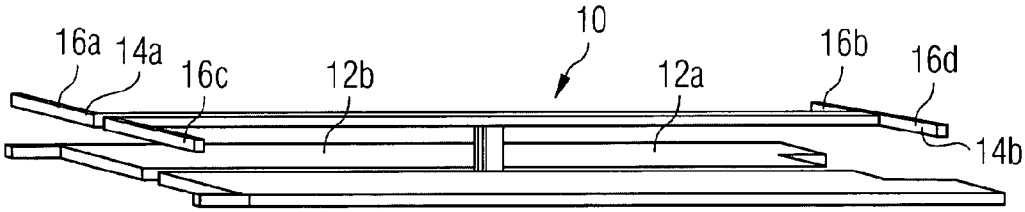
Figure 9D:
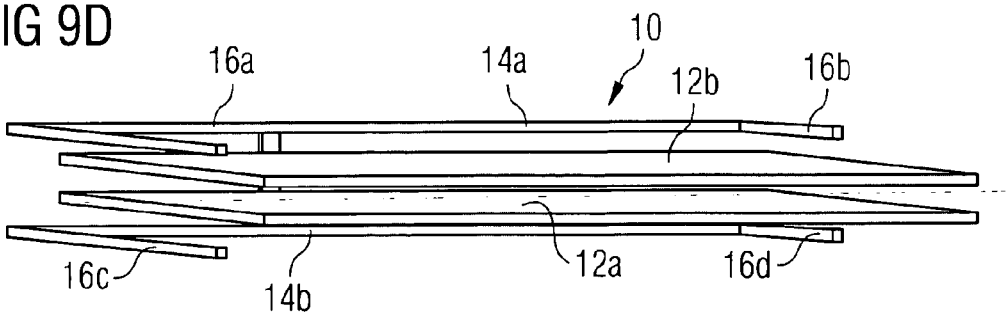

FIG. 9 shows the mobile unit according to FIGS. 5-8 in different perspectives, with FIG. 9*a* relating to FIG. 5, FIG. 9*b* relating to FIG. 6, FIG. 9*c* relating to FIG. 7 and FIG. 9*d* relating to FIG. 8.

FIG. 10 schematically illustrates in part a dipole antenna over an infinite ground plane, in part b a Dual Patch Planar Inverted L Antenna with two arms of equal length, in part c a Dual Patch Planar Inverted L Antenna with arms of different length to obtain a high frequency resonance and shows in part d an equivalent schematic of the antenna with arms of different length.

Figure 10A:
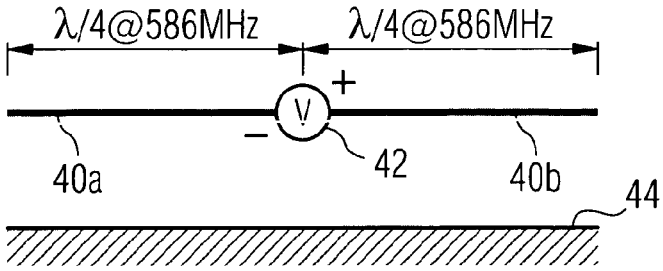
Figure 10B:
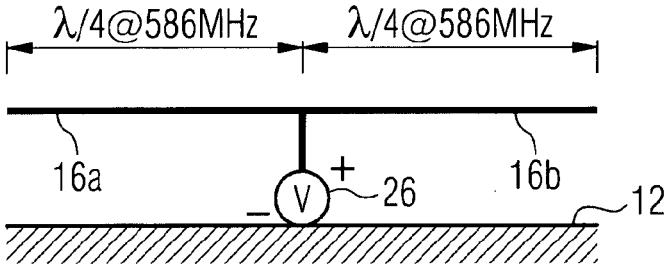
Figure 11:
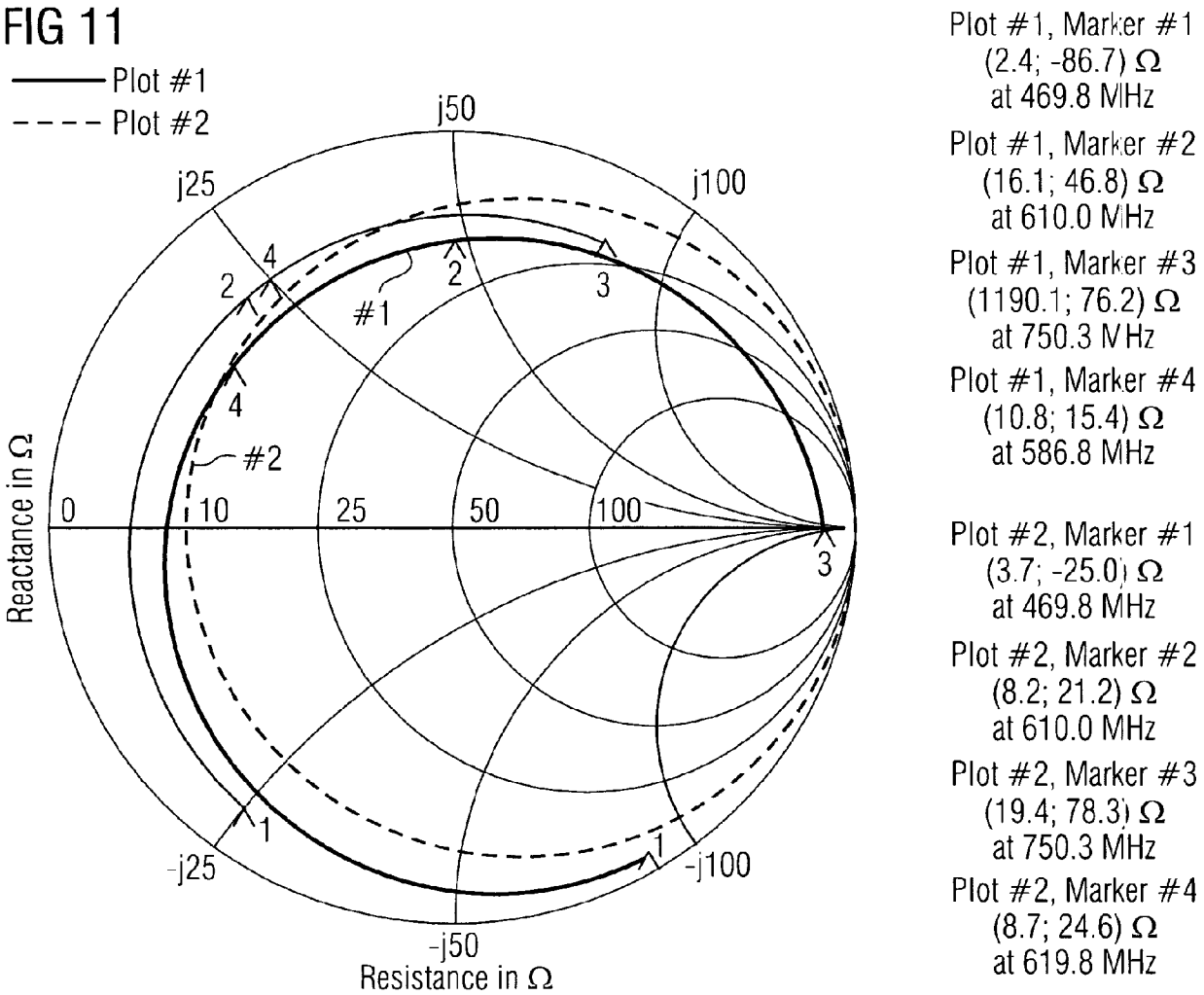

FIG. 11 shows a Smith chart comparing the characteristic impedance of the Dual Patch Planar Inverted L Antenna (plot #2) according to FIG. 10*b* with the characteristic impedance of the dipole over an infinite ground plane (plot #1) according to FIG. 10*a*.

Figure 10C:
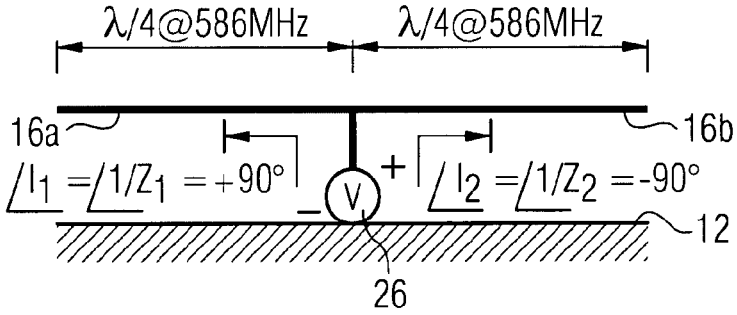
Figure 12:
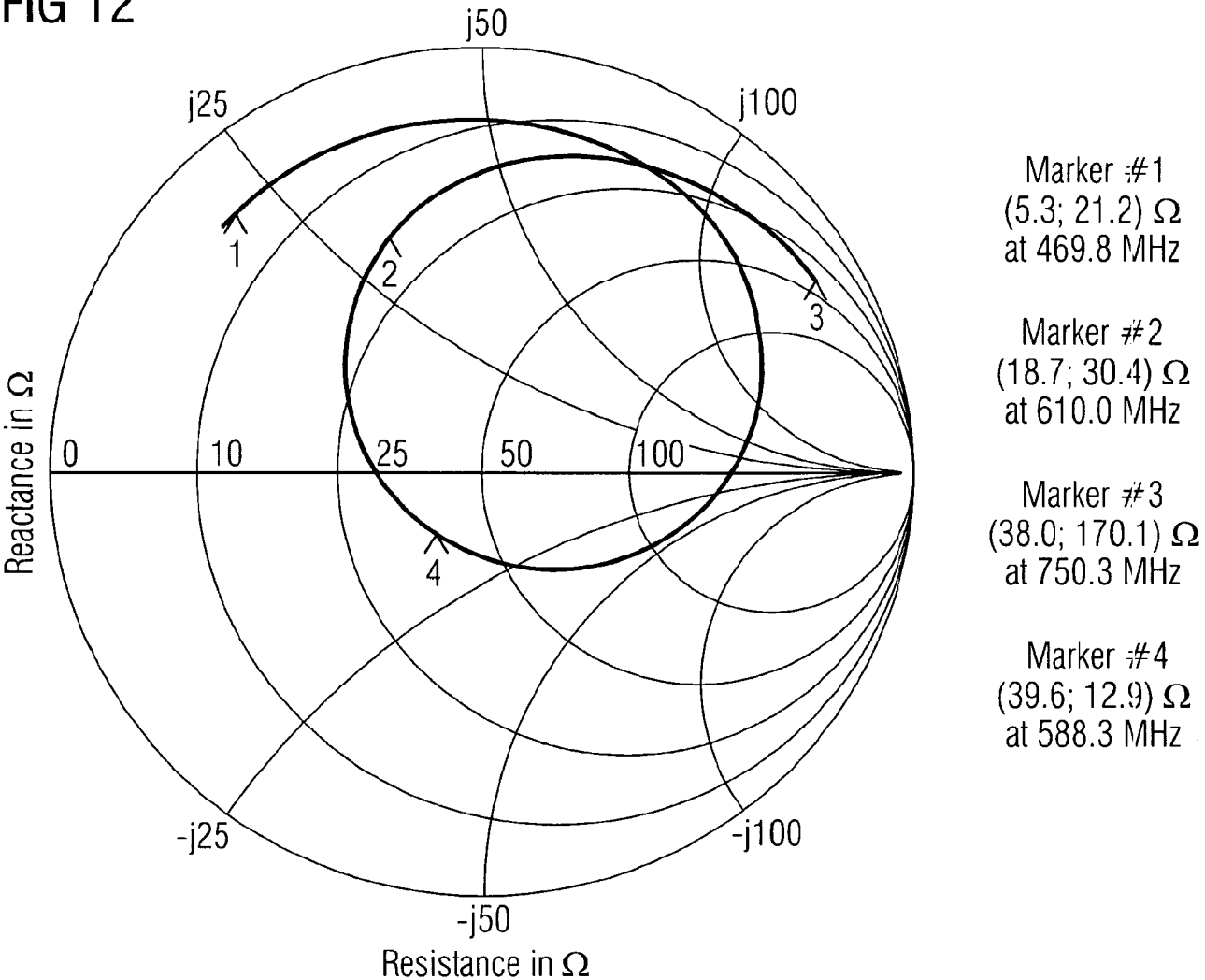

FIG. 12 shows a Smith chart of the characteristic impedance of the Dual Patch Inverted L Antenna having arms of different length according to FIG. 10*c*.

Figure 13:
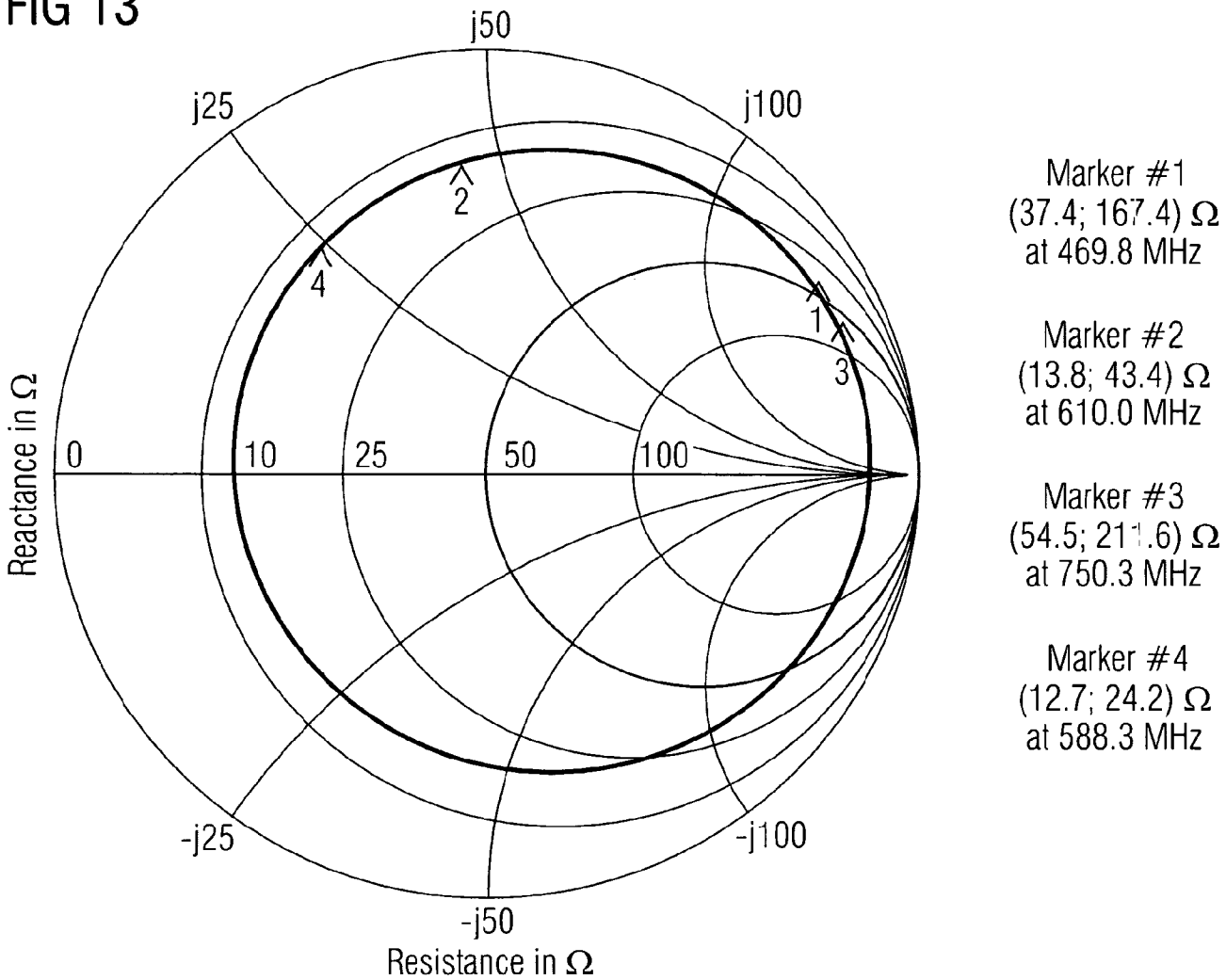

FIG. 13 shows a Smith chart of the characteristic impedance of the Dual Patch Inverted L Antenna having arms of different length according to FIG. 10*c*, assuming an optimization of the high frequency resonance.

Figure 14:
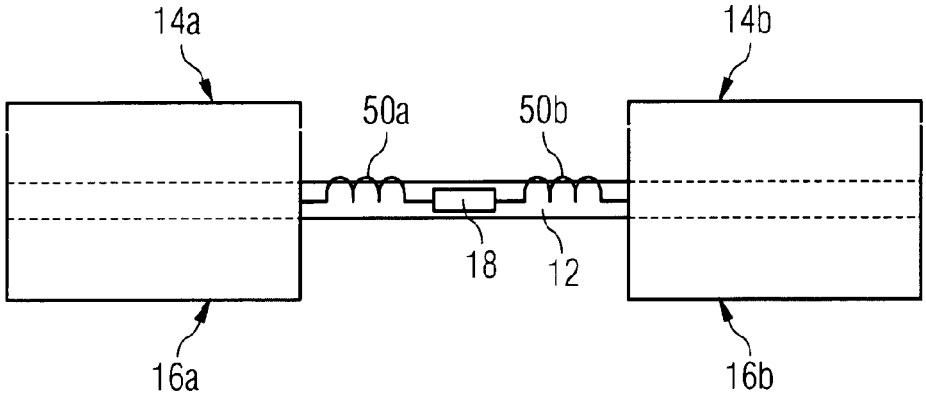

FIG. 14 illustrates a possible integration of two switching/tuning circuits represented by a respective inductor in an antenna arrangement as shown in FIG. 5, replacing the single solid antenna element by two single solid elements connected to a common feeding point by a respective switching/tuning circuit.

Figure 15:
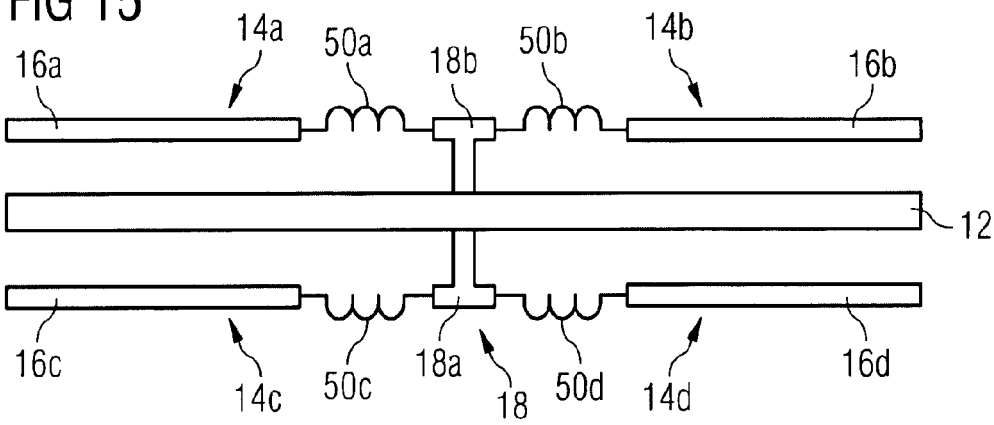

FIG. 15 illustrates a possible integration of switching/tuning circuits represented by a respective inductor in an antenna arrangement according to FIG. 6 or according to FIGS. 7 and 8 replacing the dual wire element by four wire elements connected to a common feeding point via a respective switching/tuning circuit.

Figure 16:
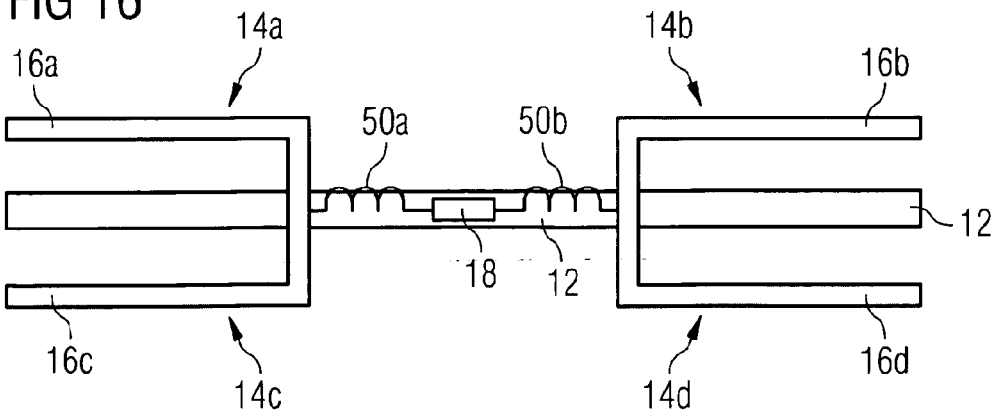

FIG. 16 illustrates another possible integration of switching/tuning circuits represented by a respective inductor in an antenna arrangement according to FIG. 6 replacing the dual wire antenna element by two dual wire antenna elements connected to a common feedpoint via a respective switching/tuning inductor.

Figure 17:
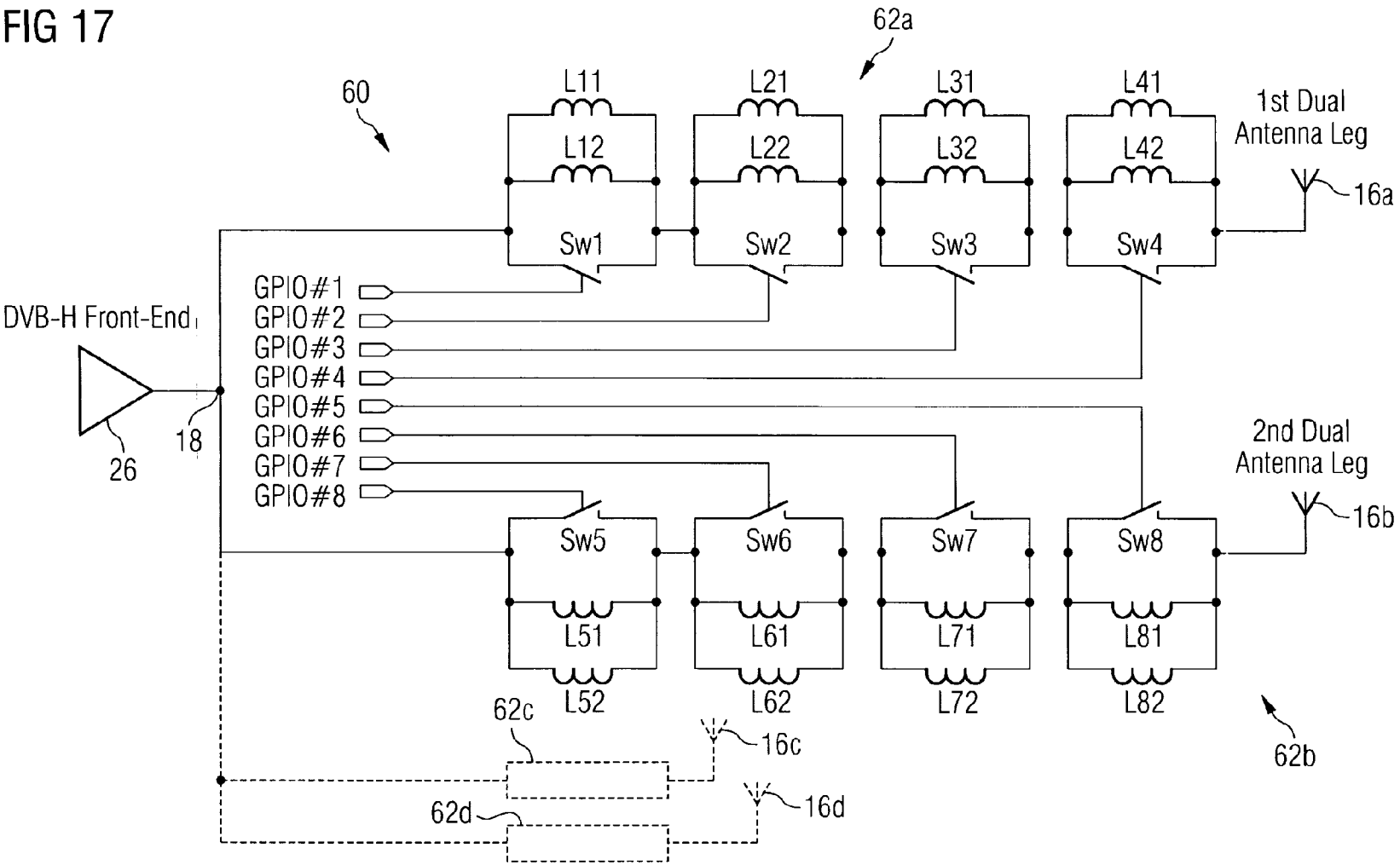

FIG. 17 shows an example for two switching circuits which may be used in accordance with FIG. 14 or FIG. 16 and indicates further an example for four switching circuits which may be used in accordance with FIG. 15.

Figure 18:
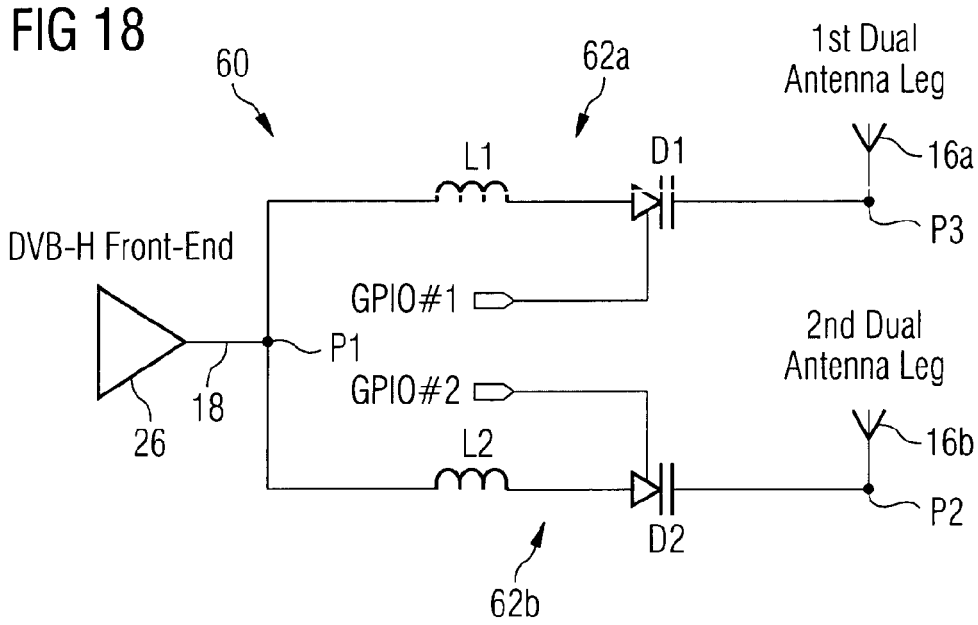

FIG. 18 shows an example for two tuning circuits which may be used in accordance with FIG. 14 or FIG. 16.

Figure 19:
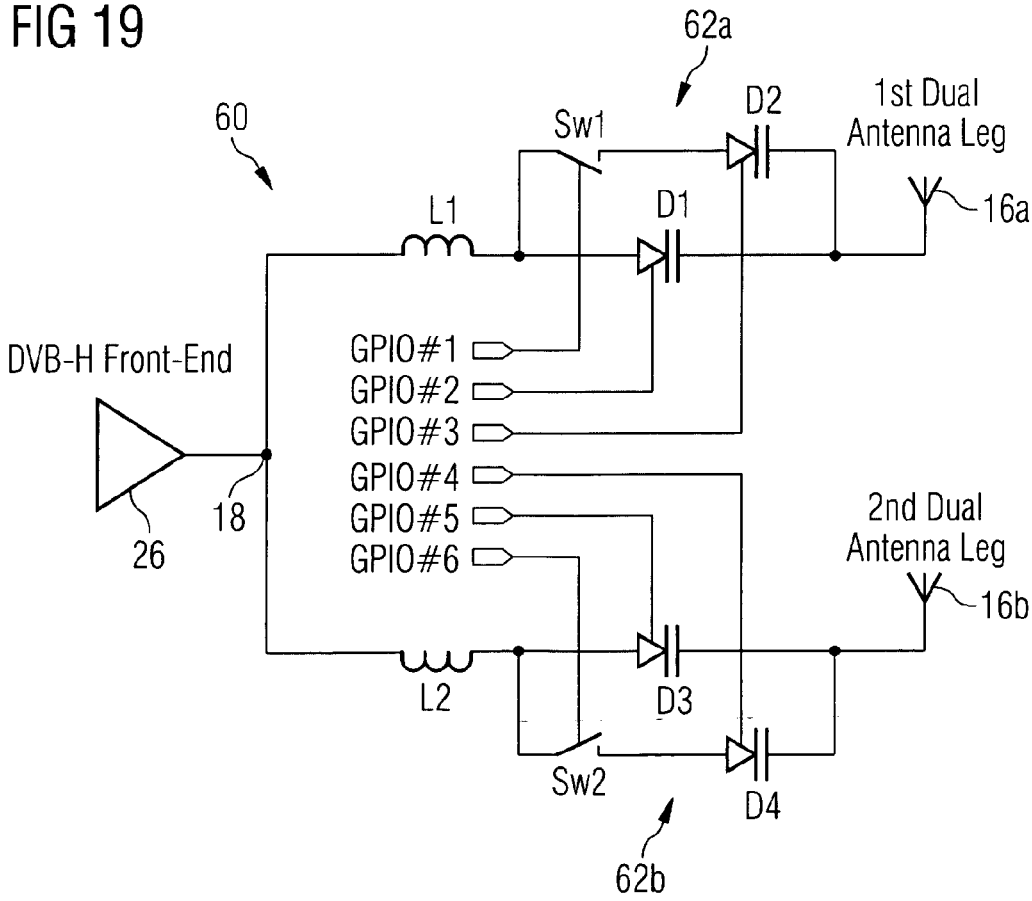

FIG. 19 shows an example for two switching and tuning circuits which may be used in accordance with FIG. 14 or FIG. 16.

Figure 20B:
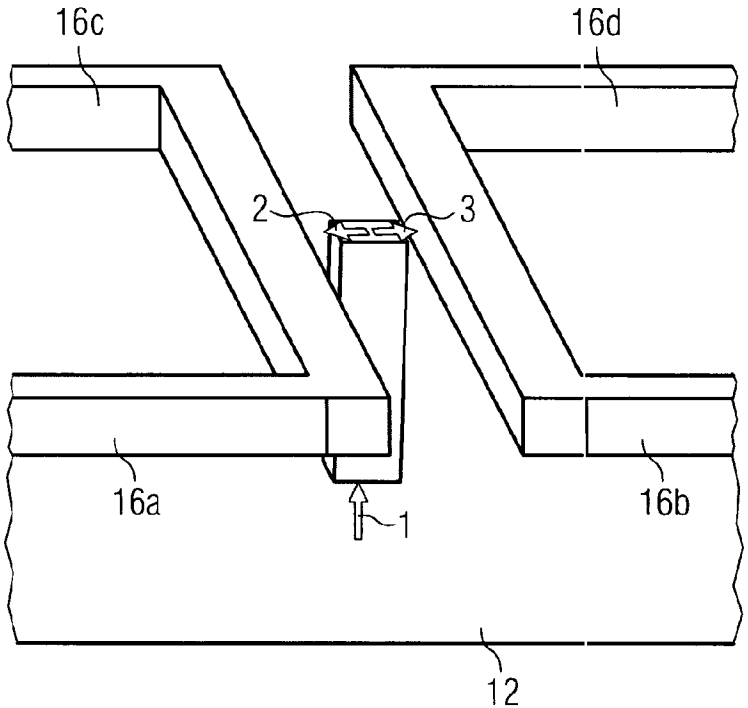
Figure 20A:
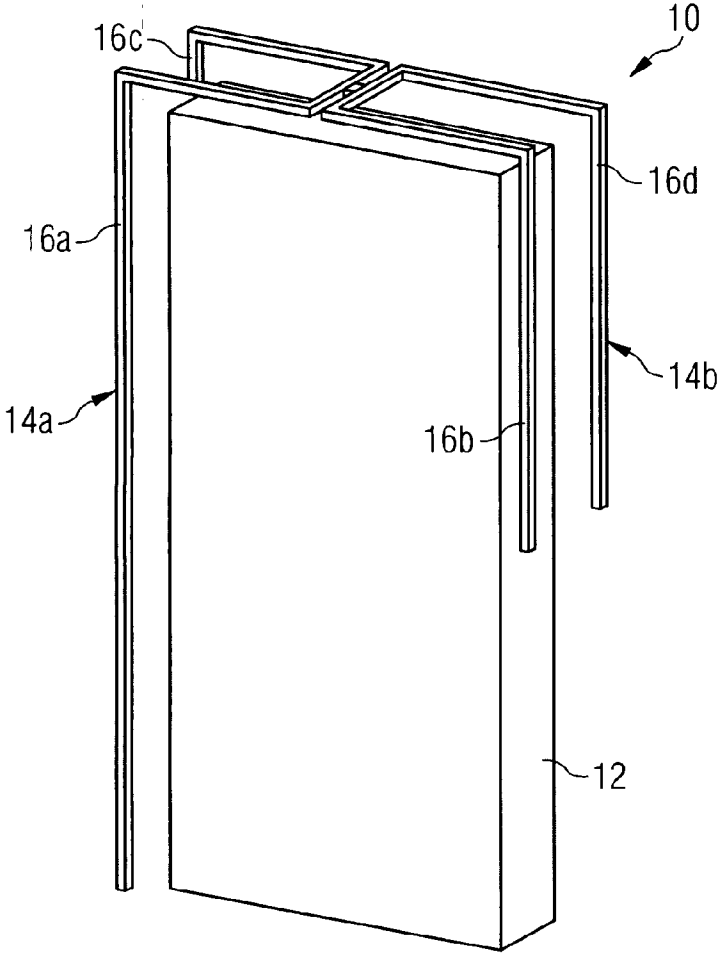
Figure 21:
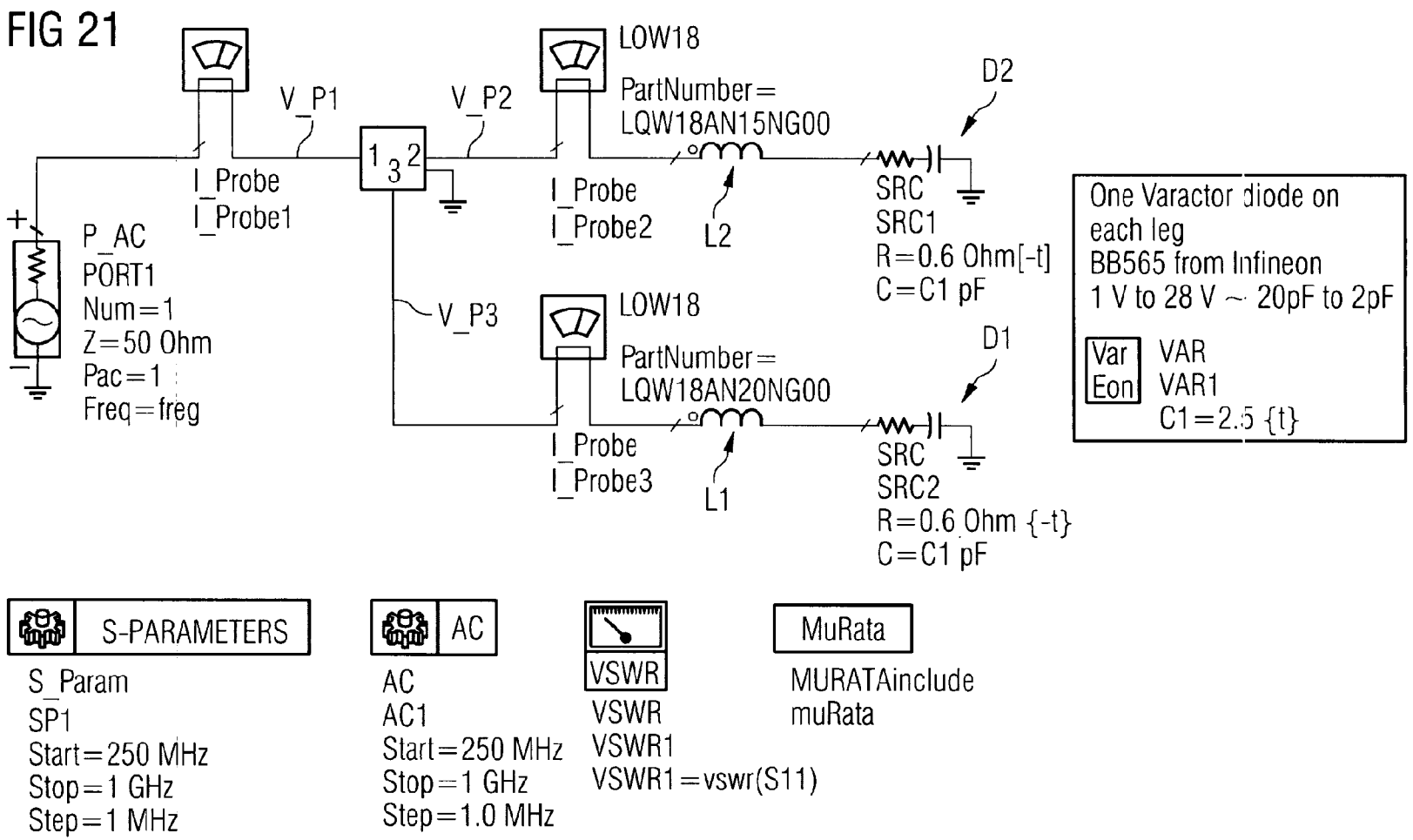
Figure 22:
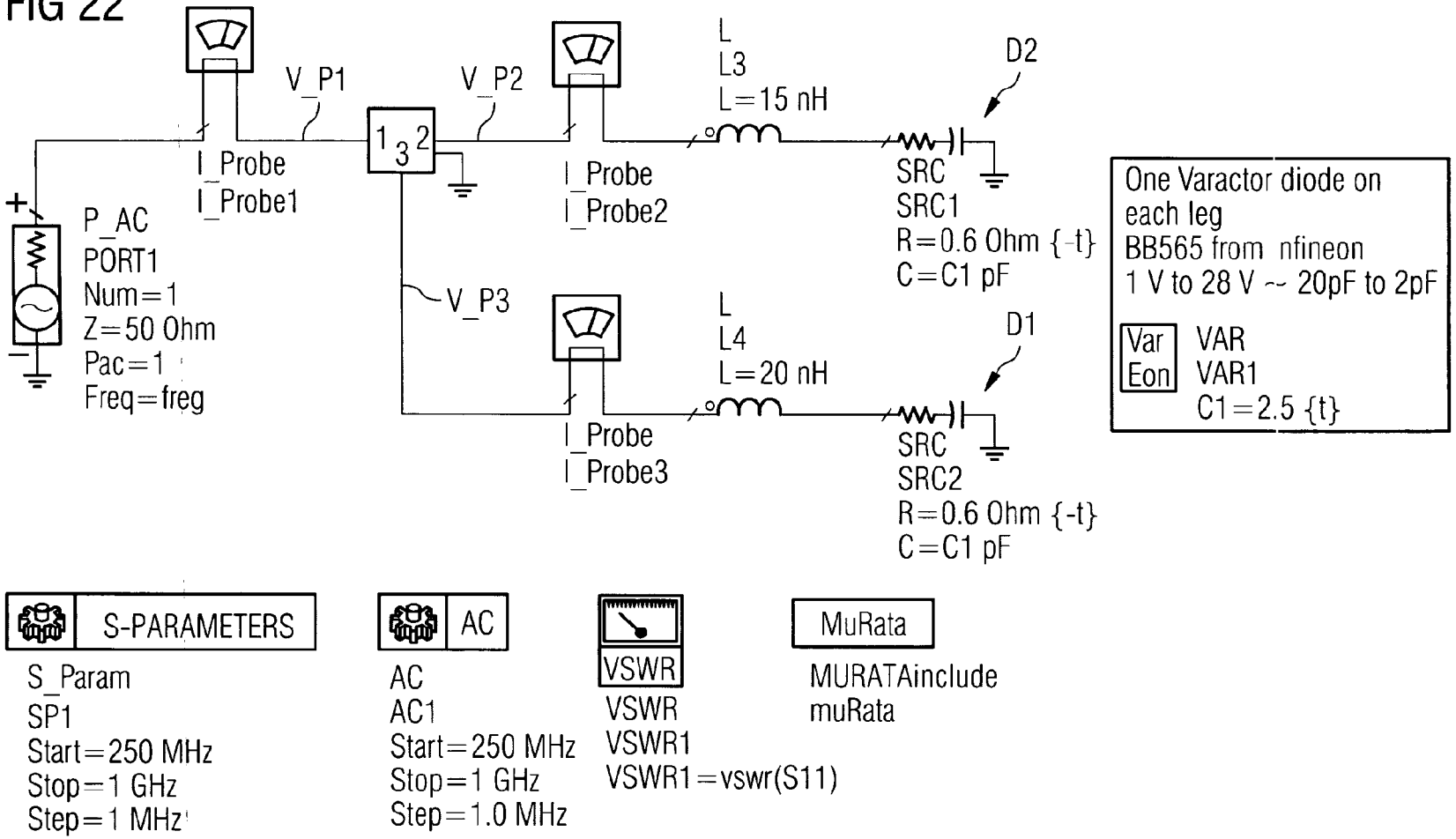

FIG. 20 illustrates in part a a model of a mobile unit having two respective wire pairs of different arm length as antenna elements located outside the periphery of a chassis, and in part b a magnified portion of the feeding side of these antenna elements and the feeding line identifying ports 1, 2 and 3 used in a matching analysis effected with an ADS circuit simulation tool shown in FIG. 21-23 for two cases.

FIG. 21 is a schematic of the simulated circuit including the antenna elements and for each antenna element a respective tuning circuit formed by an inductor and a varactor diode.

FIG. 22 is a schematic of another simulated circuit including the antenna elements and for each antenna element a respective tuning circuit formed by a varactor diode, with the inductance representing a tailoring of the antenna element itself to achieve a high frequency resonance at a low frequency within the frequency band.

FIG. 23 shows in part a simulation results for the circuit according to FIG. 21 covering a frequency range from 470 MHz to 750 MHz by tuning in 7 steps and in part b simulation results for the circuit according to FIG. 22 covering the frequency range of 470 MHz to 750 MHz by tuning in 10 steps.

It is considered that mobile terminals or mobile units for serving as receiver of digital video broadcast or digital multimedia broadcasts according existing or proposed technologies, in particular the DVB-H technology or the DMB technology can be realized to advantage according to the present invention and with its different aspects and proposals. Accordingly, the embodiments shown in the figures and explained in the following can be considered to refer to a mobile television or multimedia receiver of such a kind, in particular to a DVB-H receiver in the form of a handheld device. This device can be designed only to serve for the reception of such broadcasts. Generally, however, it will be preferred that the handheld device is a multifunctional device which also provides other functionalities, e.g. an audio- or video- or multimedia player to play corresponding media files stored in an internal storage unit of the device or/and which also can be used as mobile telephone, preferably as multiband mobile telephone according to the different relevant standards such as GSM 850, GSM 900, GSM 1800, GSM 1900 and UMTS. To this end, the frequency range which can be used for the reception of DVB-H broadcasts, e.g. the UHF-band IV and UHF-band V (474 MHz to 862 MHz) may, to a certain extent, be narrowed in view of the mobile telephone functionality of the device and, for example, when the DVB-H receiver is to be implemented in a mobile unit together with GSM 900 mobile telephone functionality, it may be appropriate to reduce the frequency range usable for DVB-H reception to a range 470 MHz to 750 MHz.

The most important field to which the invention relates is indeed the provision of mobile units for use as receiver for DVB-H broadcasts. The DVB-H technology is still in the start-up phase, so no commercial product exists at present time. However, proto types antennas for DVB-H antennas have been published and this invention results in a larger bandwidth for the same volume of the mobile unit. For a given bandwidth published proto type solutions will require a larger volume of the mobile unit, than what is necessary with this invention.

Figure 1A:
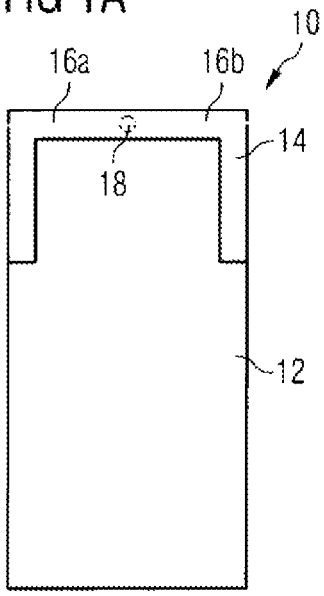
(PRIOR ART) FIG 1A
FIG. 1 shows the position of an antenna element with respect to the periphery of a PCB board according to an embodiment of the invention according to a first aspect (FIG. 1*b*) in comparison to an embodiment of the prior art (FIG. 1*a*).
Figure 1B:
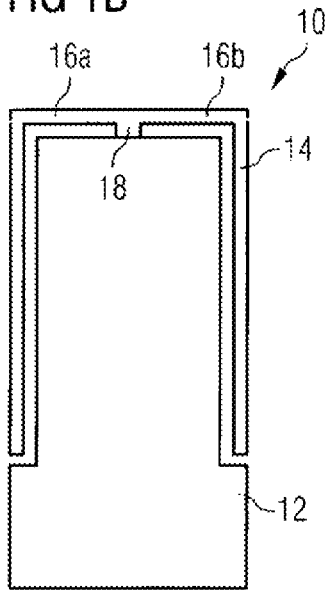
Figure 2A:
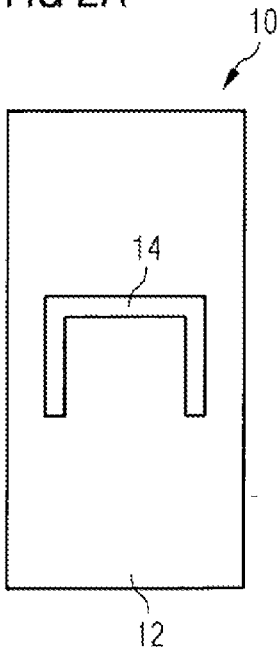
FIG. 2 shows in parts a, b and c possible places for an antenna arrangement on or with respect to the chassis of a mobile terminal, e.g. mobile telephone, whereas the position according to FIG. 2*b* gives good and the position according to FIG. 2*c* gives very good bandwidth performance due to a coupling between the antenna element and the chassis of the mobile telephone.
Figure 2B:
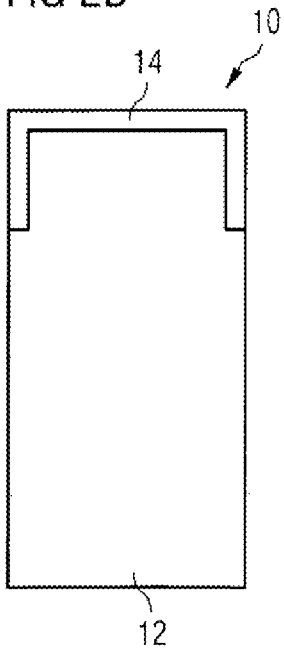
Figure 2C:
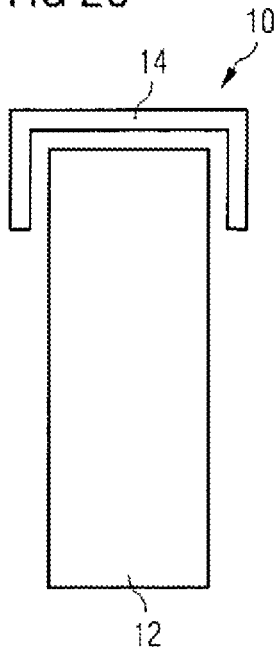

The invention, according to one important aspect, aims to provide single resonance receiver performance in a mobile unit, which is electrically small when compared to the receiving frequencies, like DVB-H. As far as the antenna is only used as a receiving antenna and not as a transceiving antenna, there is no requirement for achieving certain SAR values and it is possible to optimize the placement of the antenna element for wide bandwidth performance alone. To this end, the invention according to a first aspect proposes to place the antenna element or antenna elements around parts of the circumference of the chassis (in particular a printed circuit board, also denoted as PCB) as shown in FIG. 1*b* and FIG. 2*c* and not on top of the chassis as shown in FIG. 1*a* and FIG. 2*b* and in view of only a very bad coupling between the antenna element and the chassis not in the middle of the chassis, as shown in FIG. 2*a*.

Depending on the chosen frequency range and the dimensions of the antenna element or antenna elements on the one hand, and the chassis on the other hand, and the spatial relation therebetween, either the antenna element or antenna elements alone may act as a radiating or a receiving element or the chassis may substantially contribute to the receiving and reception or may even be the primary radiating and receiving element. As far as only reception of digital video or multimedia broadcasts is concerned, it is preferred that the dimensioning is such that the antenna element alone or in combination with the chassis acts as the receiving element for the chosen frequency range. Nevertheless, in this case the placement of the antenna element or antenna elements with respect to the chassis is of high importance with respect to the bandwidth performance. A good coupling of the antenna element or the antenna elements to the chassis is achieved by arranging the antenna element or antenna elements around part of the circumference of the chassis (cf. FIGS. 1*b* and 2*c*), giving a relatively wide bandwidth for a given volume of the mobile unit when compared to other solutions known so far, such as according to FIG. 1*a* and FIG. 2*b*.

The antenna impedance matching can to advantage be done by the antenna element or the antenna element itself and by matching components for improved bandwidth performance.

According to a second aspect of the invention the antenna arrangement has a common feed point and at least two arms, possibly branches of a common antenna element, which electrically and possibly even geometrically are located on two sides of the feed point. The arms or branches have different length to achieve a high frequency resonance, with one of the arms basically determining the resonance frequency of the antenna arrangement and the other arm basically determining the "size" of the high frequency resonance. Such an antenna element arrangement will act similar or approximately like a dipole antenna, which will be explained in more detail on basis of FIGS. 10-13 below. By means of a dipole antenna a larger bandwidth is achieved the longer the distance between the ends of the two arms or branches is (cf. FIG. 3).

In the figures showing embodiments the mobile unit has the reference sign 10. The chassis or printed circuit board has the reference sign 12 and the antenna arrangement formed by at least one antenna element has the reference sign 14. In case of a mobile unit having two bodies, the two chassis parts have reference signs 12*a* and 12*b*. As far as a plurality of antenna elements are provided, the respective antenna element has the reference sign 14 followed by a lower case letter identifying the respective antenna element. As far as an antenna element or several antenna elements provide two or more arms of certain length for providing at least one high frequency resonance, the arms each have the reference sign 16 followed by a lower case letter identifying the respective arm. Accordingly, the two embodiments of FIG. 1, each, have an antenna arrangement formed by one antenna element 14, preferably a patch type antenna element, in particular of the inverted L patch element type, and the antenna element 14 has two arms 16*a*, 16*b* which are connected with associated high frequency circuitry (not shown) located on the chassis via a common feed point or feed line 18. According to FIG. 1 the two arms have equal length. As mentioned, it is preferred that the two arms have different lengths to achieve a broad bandwidth high frequency resonance. FIG. 3 shows corresponding examples.

In all cases shown in FIG. 3 and correspondingly also in case of FIG. 1*b*, the arms 16*a* and 16*b* extend from the respective feed point 18 outwardly of and parallel to a first chassis edge and then orthogonal to the first section starting from the feed point along a respective other chassis edge outwardly thereof and parallel thereto.

Figure 3A:
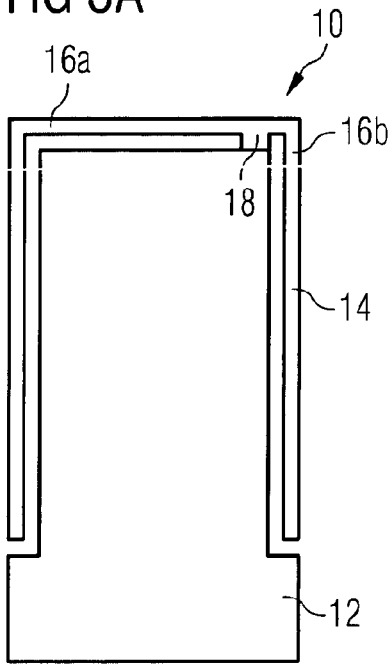
Figure 3B:
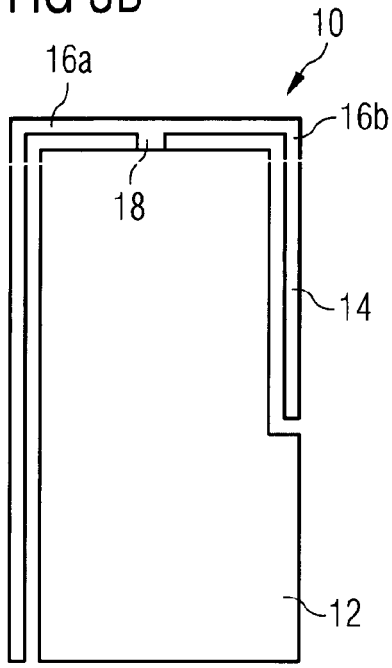
Figure 3C:
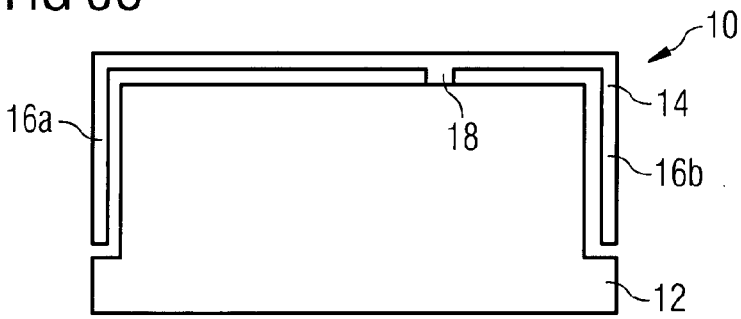
Figure 3D:
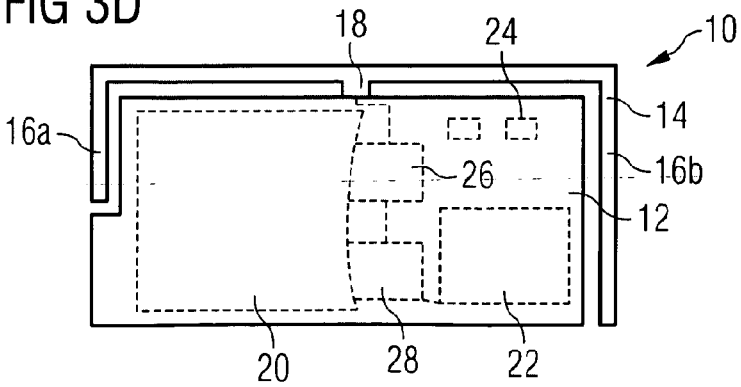

For illustration, in FIG. 3*d* some electronic means are shown on the printed circuit board in dashed lines, namely a display 20, a battery 22, control elements 24, a DVB-H front end 26 connected with the feed point 18 and receiving and processing circuitry 28, which receive a receiving signal from the front end 26 and extract the digital video or multimedia information therein and drives the display 20, a speaker arrangement (not shown) and possible audio and video connectors (not shown). The circuitry 28 can of course be provided in the form of a plurality of different high frequency and digital components.

Generally, the longer the distance of the antenna element or antenna elements from the printed circuit board PCB or other conductive parts in the mobile unit, all called "chassis", the better bandwidth performance can be achieved. Further, the width of the antenna element is an important factor for the bandwidth. The wider the antenna element is in the direction orthogonal to the plane of the chassis, the better the bandwidth will be. In this respect, it is referred to FIG. 4 in which the width W of the antenna element is indicated.

Referring again to FIG. 3, it should be noted that different positions of the antenna element for improved bandwidth performance are possible. According to FIG. 3*a* the antenna element is symmetrically arranged along the longer edges of the PCB and along one of the narrow sides of the PCB, with an asymmetric feeding at the narrow side. This solution has the lowest bandwidth performance of the four examples of FIG. 3. The asymmetric position of the antenna element with feeding at one of the narrow sides of the PCB as shown in FIG. 3*b*, gives the third best bandwidth performance of the four examples. A better bandwidth performance is achieved, if the feeding is done at one of the long sides of the PCB. The symmetric case according to FIG. 3*c* has the second best bandwidth performance, whereas the asymmetric positioning of the antenna element according to FIG. 3*d* has the best bandwidth performance of all four examples.

FIG. 5 and FIG. 9*a* show an implementation of the arrangement according to FIG. 3*a* in a monoblock phone or a monoblock receiver having a single solid antenna element 14 having the two arms of different length 16*a* and 16*b*, the feed line or feed point being indicated at 18. Instead of a single solid antenna element also a dual wire element having wires 14*a*, 14*b* is possible, as shown in FIG. 6 and FIG. 9*b*. Both wires each have two arms 16*a*, 16*b* and 16*c* and 16*d*, respectively. The two wires are connected by a short wire section 19 defining a distance between the wires 14*a* and 14*b* in a direction orthogonal with respect to the plane of the PCB 12, and the feed line 18 is connected with this connecting wire 19. The bandwidth performance of the two implementations according to FIG. 5 and FIG. 6 is almost the same. However, by providing different arm lengths with respect to the arms 16*a*, 16*c* on the one hand, or/and with respect to the arms 16*b*, 16*c* on the other hand, an additional High-Q resonance can be achieved which might be used to advantage for receiving or transmitting purposes within a respective frequency band.

The implementations according to FIGS. 3, 5 and 6 can also be applied to mobile telephones or mobile receiving units having a plurality of bodies movable with respect to each other, such as a clamshell or slider terminal. In this respect it is proposed that the antenna element is located next or around the main flip or slider PCB when the other flip or slider PCB is not provided with an antenna arrangement.

In such a mobile unit having two bodies, also other implementations of a multi antenna element arrangement, in particular of a dual or multi wire antenna element arrangement, can be used, such as illustrated with respect to a clamshell mobile unit in FIGS. 7 and 9*c*, showing the open condition, and FIGS. 8 and 9*d*, showing the closed condition of the clamshell mobile unit.

The clamshell device 10 has a first chassis 12*a*, possibly the flip chassis, and a second chassis 12*b*, possibly the main chassis, which each are located within a respective casing body and are connected indirectly or directly by a hinge mechanism and an electrical connection arrangement not shown in the figure, so that the two chassis parts and the respective body can be moved in a swivelling or folding movement between the open relative position according to FIG. 7 and the closed relative position according to FIG. 8. It should be noted that for the sake of simplicity, the embodiments of FIG. 7 and of FIG. 8 are dealt with as one embodiment, although there are slight differences with respect to the arm lengths and dimensions and shapes of the printed circuit boards 12*a* and 12*b*, which are of no relevance and only serve to indicate that there is a wide scope of variations when the invention is implemented.

By locating one of the antenna elements in the main part of the mobile unit and the other antenna element in the flip part of the mobile unit, it is ensured that the distance between the two parts of the antenna arrangements is as large as possible, so that the bandwidth is increased accordingly. The same is applicable if the flip part of the phone cannot be swiveled or folded with respect to the main part, but can be rotated by 180° around a rotation axis orthogonal with respect to the planes of the chassis parts. Optimal bandwidth performance can only be achieved for one of the two relative positions of the two bodies.

It shall now be be referred to the electrical high frequency aspects of the invention and the background thereof. The idea behind an antenna arrangement as shown, possibly implemented in the form of a Dual Patch Planar Inverted L Antenna or Dual Wire Inverted L Antenna adapted for single band operation, is to have an antenna which at the resonance frequency electrically behaves like a dipole over a ground plane. A dipole antenna consists of two arms 40*a* and 40*b*, a feed source 42 and an infinite ground plane 44 as illustrated in FIG. 10*a*. However, the feeding of a dipole antenna is done directly between the two arms, which generally is not feasible for small handheld terminals, where the feeding normally is placed between the antenna element and the ground plane, as shown in FIG. 1*b*, where the ground plane is provided by the chassis 12 which generally comprises a printed circuit board and all other conductive parts of the device, like electronic components, shielding chambers and the battery. To distinguish over the idealization of a dipole antenna over infinite ground according to FIG. 10*a*, in FIG. 10*b* the two arms of the antenna element are denoted as 16*a* and 16*b*, and the feeding source is denoted as 26 corresponding, for example, to the front end 26 shown in FIG. 3*d*.

Changing the position of the feed along the antenna element to achieve arms of different length, changes the current distributions on the antenna element and the behavior of the antenna. The antenna element according to FIG. 10*b* is more like a monopole antenna than a dipole antenna, since the phase difference of the currents flowing on the two arms at resonance frequency, e.g. 586 MHz, is around 0° instead of 180°, which is an inherit characteristic of a dipole antenna. However, the characteristic impedance of an antenna arrangement according to FIG. 10*b* is very similar to the characteristic impedance of an ideal dipole antenna according to FIG. 10*a*, as shown in the Smith chart of FIG. 11, in which plot#1 represents the antenna arrangement according to FIG. 10*b*, for example a Dual Patch Planar Inverted L Antenna, and plot#2 represents the dipole antenna over an infinite ground plane according to FIG. 10*a*. Marker #1 is located at a frequency of about 470 MHz, marker #2 is located at a frequency of about 610 MHz, marker #3 is located at a frequency of about 750 MHz and marker #4 is located on the resonance frequency of about 586 MHz for the antenna arrangement according to FIG. 10*b* (plot #1) and at a resonance frequency of about 620 MHz for the dipole antenna (plot #2) according to FIG. 10*a*. In view of the preferred application DVB-H reception only the frequency range 470 MHz to 750 MHz is shown.

A 180° phase difference as present for the dipole antenna can also be achieved when the feeding is done between the antenna element and the ground plane, as shown in FIGS. 10*b* and 10*c*. To this end, one arm must be shorter than a quarter wavelength at resonance frequency and the other arm must be longer than a quarter wavelength at resonance frequency, as shown in FIG. 10*c*. The shorter arm will be more capacitive and introduce a +90° phase shift of the currents flowing on the shorter arm, while the longer arm will be more inductive and introduce a −90° phase shift on the current flowing on the longer arm, giving a total phase difference of 180°.

Figure 10D:
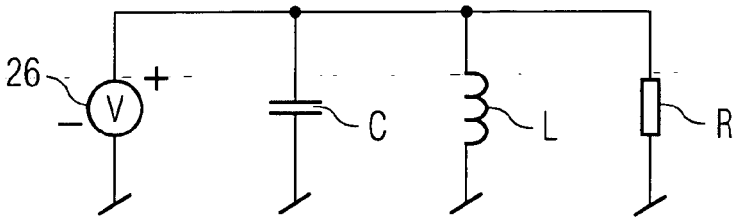

Such a structure will be more capacitive the lower the frequency is and more inductive the higher the frequency is. The contributions of the capacitive and inductive part of the antenna will be equal at resonance frequency, and the antenna will accordingly behave like a dipole over a ground plane. An equivalent schematic of such an antenna structure is shown in FIG. 10*d*. The equivalent circuit corresponds to a parallel resonator provided by the capacitive part C, the inductive part L and the radiation resistance R.

The impedance between the two arms of the antenna element adds an additional resonance compared to the traditional dipole antenna over an infinite ground plane. This additional resonance can be seen in the impedance plot of FIG. 12, showing the characteristic impedance for the antenna arrangement according to FIGS. 10*c* and 10*d*, with markers #1, #2, #3 and #4 set at the frequencies of about 470 MHz, 610 MHz, 750 MHz and 588 MHz, respectively, the frequency 588 MHz approximately being the resonance frequency.

By appropriately optimizing the lengths of the two arms, the additional resonance obtained for the antenna element having different arm lengths shorter and longer than a quarter wavelength, respectively, may be enlarged in frequency and impedance space as shown in the impedance plot of FIG. 13, so that a very broad high frequency resonance and accordingly very good bandwidth performance can be achieved.

Concerning the impedance plots of the Smith charts according to FIG. 11, plot #1, and FIGS. 12 and 13 it should be added that the simulations have been done assuming an infinite ground plane. This was done for simplicity in order to avoid any impact from the chassis, like the size of it and where the antenna is positioned. However, the general behavior and the theory described in the foregoing is still valid if an electrically small finite ground plane as provided by the chassis of a mobile unit, e.g. mobile telephone or mobile DVB-H handheld receiver, is present.

Of course, the size of the chassis and the position of the antenna element compared to it are very important for the achievable impedance bandwidth. The optimal size of the chassis is achieved with a circumference equal to the wavelength of the resonance frequency. A chassis with a circumference that is bigger or smaller than the resonance frequency will result in a smaller impedance bandwidth, with a smaller circumference tending to be better than a larger circumference. Further, as already mentioned, the obtainable bandwidth for a given size of the chassis is determined by how good the electromagnetic coupling between the antenna element or antenna elements and the chassis is. Having the antenna element located in the middle of the chassis, as shown in FIG. 2*a*, results in a bad electromagnetic coupling and thereby a reduced bandwidth. The electromagnetic coupling is increased the closer the antenna element is to the edge of the chassis (FIG. 2*b*) and the best electromagnetic coupling is achieved when the antenna is located outside the chassis (FIG. 2*c*).

The invention ensures a resonance within the respective frequency band, for example the UHF band IV and V, in which the DVB-H frequencies are located. Furthermore, a compact design for DVB-H receivers and mobile telephones can be achieved by the invention. Simulations show that it is possible to implement an antenna occupying only 11 $cm^3$ in a PCA size device of about 135×80×11 mm without tuning or switching of the antenna or the matching of the antenna, and still obtaining a broad bandwidth performance. As long as tuning or switching is avoided, the invention can be implemented very easily at a low complexity. In particular, it is possible to reduce the overall size of the respective device and still use an internal antenna without tuning and switching, in contrast to other published internal antenna solutions for such mobile units.

Nevertheless, switching or tuning of the transmitting and receiving characteristics of the antenna arrangement is an option, when the invention is to be implemented, and can give considerable advantages, at the expense of somewhat increasing the complexity.

By switching or tuning the reception and transmission characteristics of an antenna arrangement, the performance of the respective antenna arrangement, such as the antenna arrangements discussed in the foregoing, can be enhanced. To this end, switching or tuning circuits can be implemented in the antenna structure, and the enhancement aims at reducing the overall size of the antenna by maintaining basically the same receiving or/and transmission performance. The antenna structures discussed in the foregoing cover the whole system bandwidth by itself and may require only a simple matching circuit for optimal performance. However, even though the complexity of such an antenna structure is very low, it requires a relatively large volume. This volume can be reduced by switching/tuning the antenna. Reducing the volume has the effect that the bandwidth of the antenna itself is smaller than in case of a larger volume, and accordingly, the bandwidth of the antenna itself may be smaller than the system bandwidth. However, by switching or tuning the resonance frequency of the antenna, the whole system bandwidth can be covered. There is a trade-off between the complexity of the system on the one hand and the volume of the system on the other hand. Due to the switching/tuning circuit or circuits, the complexity is somewhat increased, but the required volume for the antenna is reduced.

There are many techniques known for switching or tuning of antennas. However, according to a third aspect of the invention, a special way of implementation of the switching or tuning is proposed, which is based on the change of effective inductance or/and capacity values of an inductor or capacitor or generally a switching or tuning circuit positioned at the beginning of a respective one of the antenna arms between the antenna arm and the feeding point as shown in FIGS. 14-16. FIG. 14 illustrates a corresponding implementation of two switching or tuning circuits represented by a respective inductor 50*a* and 50*b*, electrically located between an antenna patch arm 16*a* and the feed point 18 and an antenna patch arm 16*b* and the feed point 18, respectively, on basis of the antenna structure shown in FIG. 5. The one patch like antenna element 14 having integrally two arms 16*a*, 16*b* is replaced by separate patch antenna elements 14*a* and 14*b*, each forming an arm 16*a* and 16*b*, respectively, of the antenna structure.

On basis of the construction according to FIG. 6 an antenna structure having integrated four tuning or switching inductors 50*a*, 50*b*, 50*c* and 50*d* or four tuning or switching circuits 50*a*, 50*b*, 50*c* and 50*d*, represented thereby, is provided, as shown in FIG. 15, each inductor or circuit being connected in series between a feed point 18*a*, 18*b*, respectively, and the respective antenna element. Instead of two wire antenna elements 14*a*, 14*b*, each having two arms 16*a*, 16*b* and 16*c* and 16*d*, respectively, in the case of FIG. 6, here the antenna arrangement is formed by four wire like antenna elements 14*a*, 14*b*, 14*c* and 14*d*, each forming a respective arm 16*a*, 16*b*, 16*c* and 16*d* of the antenna arrangement. The two feed points 18*a* and 18*b* are electrically connected to form a common feed point 18.

Instead of four inductors or tuning or switching circuits integrated in the wire element antenna arrangement, there may be only two inductors 50*a* and 50*b* similar to the situation in FIG. 14, as illustrated in FIG. 16. The arms 16*a* and 16*c* may be provided by one wire antenna element 14*a* and the arms 16*b* and 16*d* may be provided by another wire antenna element 14*b*, these antenna elements 14*a* and 14*b* being each electrically linked with the feed point 18 by the respective inductor or switching/tuning circuits 50*a* and 50*b*, respectively.

Concerning the arm lengths of the arms 16*a* and 16*b* in FIG. 14, of the arms 16*a*, 16*b*, 16*c* and 16*d* in FIG. 15 and the arms 16*a*, 16*b*, 16*c* and 16*d* in FIG. 16, the situation may be as shown in FIG. 5 in case of FIG. 14, and as shown in case of FIG. 6 in case of FIGS. 15 and 16, so that there are one or two arms shorter than the resonance frequency and one or two arms longer than the resonance frequency. In case of the wire antenna structures, however, it can easily be provided that all arms have different lengths, so that at least one additional resonance can be achieved, as already mentioned.

Generally, the number of inductor or capacitor tuning circuits used for the switching/tuning can vary, for example from 1 to 4. The achievable reduction of the size of the chassis and of the volume is independent of the number of tuning or switching circuits. However, a better tuning of the antenna structure can be achieved if at least two different switching or tuning circuits are provided. A good solution in terms of tuning capabilities on the one hand, and complexity on the other hand, is the provision of two different tuning or switching circuits.

If two switching or tuning circuits are used, one is placed at the beginning of the shorter arm of the antenna and the other at the beginning of the longer arm of the antenna, the tuning or switching circuit located at the beginning of the shorter arm can be used to tune the resonance frequency in the system frequency range. The other tuning or switching circuit placed at the beginning of the longer arm of the antenna can be used to determine the width of the bandwidth and the standing wave ratio SWR of the resonance frequency, whereas a good SWR can be achieved at the expense of antenna bandwidth.

Preferably, the tuning or switching circuit presents an inductance. The higher the inductance (inductor) value is, the lower the resonance will be. The tuning or switching circuit may alternatively present a capacitance. The higher the capacitance (capacity) value is, the higher the resonance will be. If an inductance is presented, this corresponds to an electrical lengthening of the antenna arm. If a capacitance is presented, this corresponds to an electrical shortening of the antenna arm. Preferably, always an effective inductance value is presented, which—however—may be increased or decreased by means of a tunable or/and switchable capacitance integrated in the tuning or switching circuit.

One of the advantages of using tuning or switching circuits, preferably inductor tuning or switching circuits, positioned at the beginning of each arm of the antenna, is that the topology of components which can be used are independent of the impedance and phase of the antenna. The inductor—or more generally the inductor or capacitance or even more generally the tuning or switching circuits—electrically lengthen or shorten the two arms and accordingly can be used to tune the desired frequency. By this tuning a more compact design is possible, since the size of the chassis can be reduced significantly, for example up to around 30%.

Concerning the implementation of one or several switching circuits, tuning circuits or switching and tuning circuits in the antenna arrangement, the invention is not limited to a certain approach or solution. Generally, it is preferred that the respective circuit or respective components are integrated in or held on the chassis, in particular the printed circuit board. However, it is not ruled out that the respective circuit or respective components are integrated in the antenna arrangement itself.

FIG. 17 shows an example of a switching circuit arrangement 60 having a first switching circuit 62*a* associated to a first antenna arm 16*a* and a second switching circuit 62*b* associated to a second antenna arm 16*b* of an antenna arrangement formed by said two arms 16*a* and 16*b*. For example, these arms could correspond to the arms 16*a* and 16*b* of FIG. 14. Alternatively, the two switching circuits 62*a* and 62*b* could be connected to the antenna elements 14*a* and 14*b* of FIG. 16, each having two parallel arms 16*a* and 16*c* and 16*b* and 16*d*, respectively. In case of an antenna arrangement as shown in FIG. 15, there could be two additional switching circuits 62*c* and 62*d* of the same kind as the switching circuits 62 a and 62*b*, as represented in dashed lines in FIG. 17.

The respective switching circuit changes the values of the series inductors placed at the beginning of the associated respective antenna arm of the dual antenna arms or four antenna arms. The tuning of the inductors is done by switching in and out one or more of four series inductors, each series inductor possibly being implemented on basis of two inductors switched in parallel as shown in FIG. 17. Using parallel inductors instead of one inductor having a corresponding higher inductively might facilitate to provide required inductor values on basis of standard components, since the match to the antenna and the switching might require non-standard inductor values. It should be added that it might not be necessary to use four switches for each switching circuit. The number of switches of each switching circuit and the overall number of switches of the overall switching circuit arrangement 60 will depend on the required system bandwidth. For example, for a frequency range from 470 MHz to 750 MHz, four switches for each switching circuit for a situation according to FIG. 14 or FIG. 16, will be appropriate.

According to another approach, the high frequency resonance is not switched between different frequency positions on the frequency scale, but continuously tuned or stepwise tuned along the frequency scale on basis of tuning elements. FIG. 18 shows an example. The two tuning circuits 62*a* and 62*b* each are formed by a discrete inductor L1 and L2 and a tunable element D1 and D2 having a tunable capacity. Varactor diodes may for example be used as tuning elements. For a single varactor diode for example a capacity range from around 2.0 pF to 23.0 pF can be obtained on basis of a control voltage applied to the varactor diode ranging from 2.0 V to 28.0 V.

The advantage of such a configuration is that the number of used components is independent of the system bandwidth and that the total number of components is low. Tolerances of the varactor diodes can be coped with on basis, for example, a kind of adaptive matching algorithm or by calibration of each device in the production.

FIG. 19 shows an implementation which is based on low voltage varactor diodes (control voltage range 0.5 V to 3.0 V) with a corresponding smaller capacity range. To cover the system bandwidth, for example two varactor diodes are required for each switching circuit 62*a* and 62*b*, one being switchable in a parallel connection with the other by means of switch Sw1 and Sw2, respectively.

For example, a capacity range from around 2.2 pF to 6.5 pF and 5.0 pF to 25.0 pF can be obtained on basis of such two low voltage varactor diodes in order to cover the system bandwidth. Again, the number of used components is independent of the system bandwidth and the total number of components is relatively low. Tolerances of the varactor diodes can again easily be coped with, for example by some kind of adaptive matching algorithm or calibration of each device in the production.

FIGS. 17-19 show no examples for the realization of bias and control networks associated to the switches and varactors. Such networks can easily be implemented by a man skilled in the art and can be controlled by an electronic processor of the mobile unit.

An important aspect of the embodiment shown in FIGS. 17-19 is that there is no common tuning circuit associated to both or all four antenna arms, located between the front end 26 and a common feed point for the antenna arms, but that each antenna arm has its own switching or tuning circuit located between the common feed point and the respective antenna arm. This allows that the effective electrical length of each antenna arm can be tuned or switched individually, so that the position of the high frequency resonance on the frequency scale on the one hand, and the bandwidth or standing wave ratio SWR on the other hand can both be controlled.

Concerning the embodiments of FIGS. 18 and 19 it should be added that the antenna arm (which is denotable also as antenna leg) itself and the respective inductor L1 and L2, respectively, give a certain effective electrical length, which can be reduced by increasing the capacity of the varactor diode D1 and D2, respectively. Accordingly, by increasing the capacity, the position of the high frequency resonance is increased from a lower frequency in the frequency band to a higher frequency in the frequency band. A high frequency resonance at a lower frequency in the frequency band for low capacity of the varactor diode could also be obtained by tailoring the antenna arms appropriately with respect to length and other parameters, so that the inductors L1 and L2 connected in series with the respective varactor diode (D1 and D2, respectively) or varactor diodes (D1, D2 and D3, D4, respectively) could be omitted.

Concerning the embodiment of FIG. 17, an increase of the series inductance by correspondingly switching the switches Sw1 to Sw4 and Sw5 to Sw8, respectively, leads to a stepwise shifting of the high frequency resonance on the frequency scale from a higher frequency in the frequency band to a lower frequency in the frequency band, corresponding to effectively lengthening the electrical length of the antenna arms as seen from the front end 26.

Referring to FIG. 18 the tuning achievable by means of the varactor diodes is illustrated further in the following on basis of simulation results obtained by means of a circuit simulation tool (ADS), wherein an antenna arrangement similar to FIG. 16 is assumed, as shown in FIG. 20*a*. FIG. 20*b* identifies three ports numbered port 1, port 2 and port 3 used in the circuit simulation for calculating the high frequency voltages and currents at the common feed or branch point P1 (port 1) and connection points P2 (port 2) and P3 (port 3) to the antenna arms 16*a* and 16*c* of the antenna element 14*a*, and the antenna arms 16*b* and 16*d* of the antenna element 14*b*. To this end, the reference signs 16*a* and 16*b* in FIG. 18 should be considered to be replaced by reference signs 14*a* and 14*b*.

FIG. 21 shows a schematic circuit diagram, on which the simulation is based and which identifies the high frequency currents and high frequency voltages calculated in the simulation for obtaining the power $P_{rad}$ and the reflected power or mismatch loss ML in dBWatt.

Figure 23A:
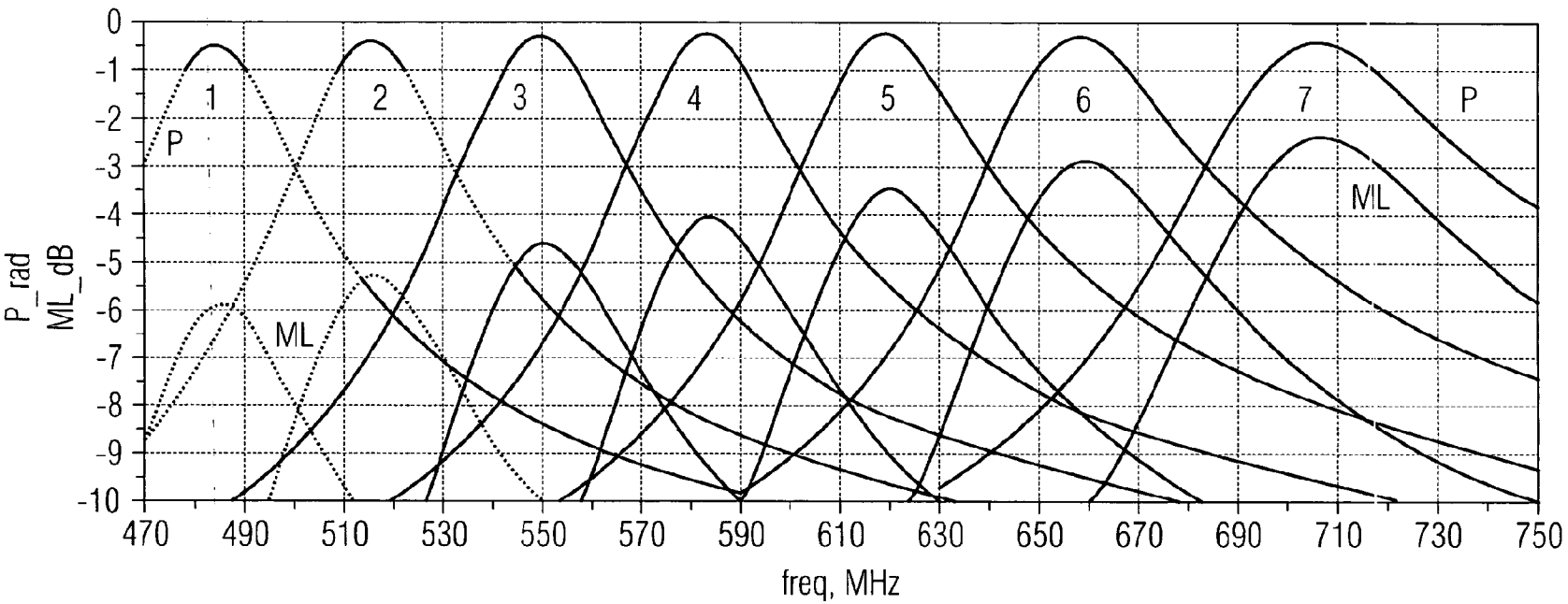
Figure 23B:
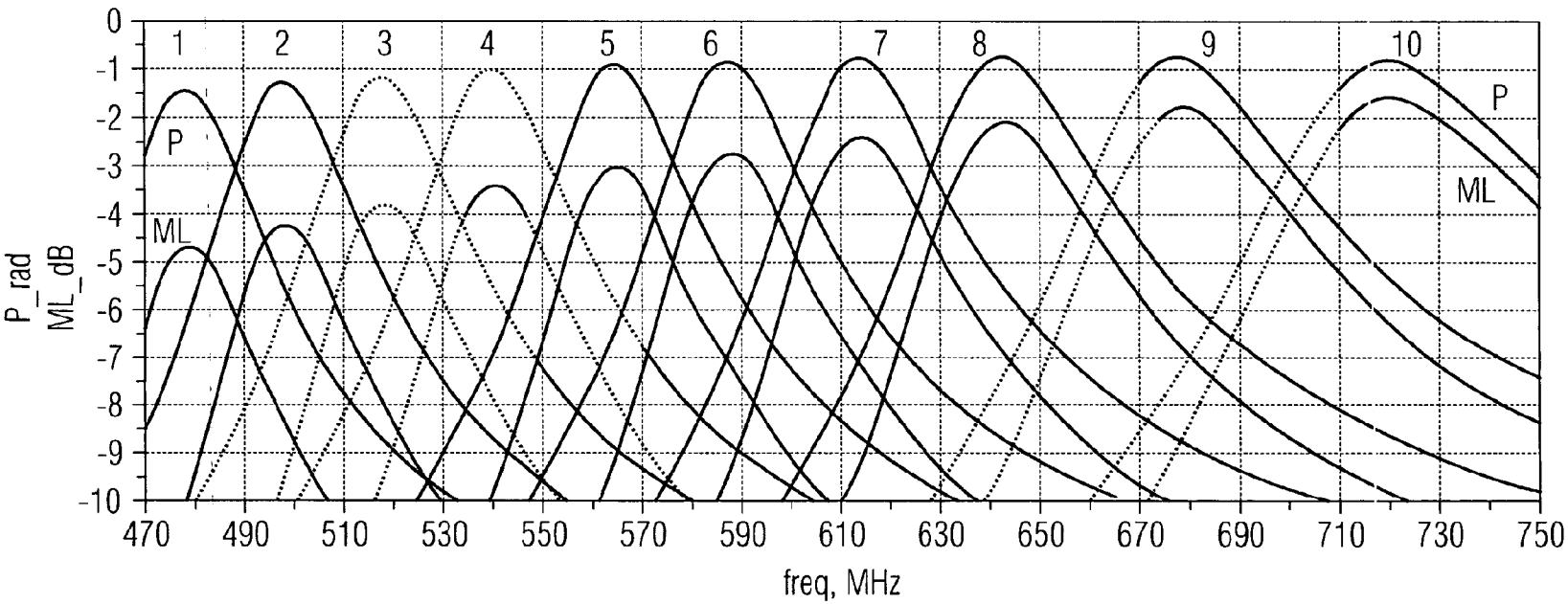

FIG. 23*a* shows the shifting of the high frequency resonance obtained by stepwise changing the capacity of both varactor diodes D1 and D2 in seven steps between 2.5 pF and 20.0 pF shown in the table below the dB over frequency diagram. Instead of simultaneously changing the capacity of both varactor diodes by the same value, it is also possible to change the capacity of the two varactor diodes differently.

For FIG. 21 and FIG. 23*a* inductance values of 20 nH for inductor L1 and 15 nH for inductor L2 were assumed, including further parameters of a real wire wound coil.

FIG. 22 shows a further (alternative) schematic circuit diagram. It is assumed that an inductor L3 of 15 nH and an inductor L4 of 20 nH are present corresponding to ideal coils. These inductors represent such an implementation of the antenna arrangement that corresponding respective electrical lengths of the antenna arms lead to a positioning of the high frequency resonance at a low frequency within the frequency band for low capacity of the varactor diode, and that the high frequency resonance is shifted to higher frequencies by increasing the capacity of the varactor diodes. This corresponds to the situation mentioned as an alternative in the context of FIG. 18, wherein the inductors L1 and L2 are omitted, and instead thereof the antenna arms are correspondingly implemented.

Having the high frequency resonance at a low frequency within the frequency band for low capacity of the varactor diodes, has the consequence that the bandwidth is lower for the same antenna volume as when the high frequency resonance is positioned at a higher frequency in the frequency band without external tuning or shifting. Accordingly, for covering the same frequency range, correspondingly more tuning steps are necessary. This is reflected in FIG. 23, where according to FIG. 23*a*, relating to the situation in FIG. 21, there are seven tuning steps for covering the frequency range and where according to FIG. 23*b*, relating to the situation in FIG. 22, there are ten tuning steps used for covering the same frequency range by tuning the capacity of the two varactor diodes between 2.3 pF and 22.0 pF.

The invention claimed is:

1. A mobile terminal, comprising:

a casing with at least one body having an electrical part; and an antenna arrangement having at least one antenna element provided within said body or within at least one of several bodies of said casing in a defined spatial relation to a conducting chassis part of the body or the respective body allowing a high frequency interaction between the antenna arrangement and the conducting chassis part, said antenna arrangement together with associated high frequency circuitry operative to at least one of receiving wireless transmissions and transmitting wireless transmissions in at least one pre-determined frequency band, said conducting chassis part being limited by a periphery of the conducting chassis part formed by one chassis part edge or several chassis part edges;

wherein said antenna element has at least one arm which extends outwardly of said periphery along at least one chassis part edge for promoting said high frequency interaction, and said antenna arrangement has at least two arms of different length which are provided by the same antenna element or at least two different antenna elements, said arms to extend in different or opposed directions outwardly of said periphery along at least one chassis part edge.

2. The mobile terminal of claim 1, wherein a shorter arm of said two arms has an effective electrical length shorter than a quarter wavelength at a resonance frequency within the or a particular predetermined frequency band and a longer arm of said two arms has an effective electrical length longer than a quarter wavelength at said resonance frequency, so that a high frequency resonance is obtained for at least one of receiving wireless transmissions and transmitting wireless transmissions within a resonance bandwidth associated to the high frequency resonance.

3. A mobile terminal, comprising:

a casing with at least one body which has an electronic part;

an antenna arrangement having at least one antenna element provided on or within said body or on or within at least one of several bodies of said casing in a defined spatial relation to a conducting chassis part of the body or the respective body allowing a high frequency interaction between the antenna arrangement and the conducting chassis part, said antenna arrangement together with associated high frequency circuitry being adapted to at least one of receiving wireless transmissions and transmitting wireless transmissions in at least one predetermined frequency band, said or each conducting chassis part being limited by a periphery of the conducting chassis part formed by one chassis part edge or several chassis part edges; and wherein said antenna arrangement has at least two arms of different length which are provided by the same antenna element or at least two different antenna elements and which extend in different or opposed directions along at least one chassis part edge, with a shorter arm of said two arms has an effective electrical length shorter than a quarter wavelength at a resonance frequency within the or a particular predetermined frequency band and a longer arm of said two arms has an effective electrical length longer than a quarter wavelength at said resonance frequency, so that a high frequency resonance is obtained for at least one of receiving wireless transmissions and transmitting wireless transmissions within a resonance bandwidth associated to the high frequency resonance.

4. The mobile terminal of claim 3, wherein said two arms extend outwardly of said periphery along at least one chassis part edge for promoting said high frequency interaction.

5. The mobile terminal of claim 3, wherein said or at least one shorter arm and said or at least one longer arm are directly electrically connected with each other as sections of a common antenna element.

6. The mobile terminal of claim 3, wherein said or at least one shorter arm and said or at least one longer arm are electrically connected with each other via at least one switching or tuning circuit, which is operable to frequency shift said high frequency resonance within said predetermined frequency band continuously or stepwise.

7. The mobile terminal of claim 6, wherein the shorter arm, the longer arm, or both the shorter and the longer arm, have associated a switching or tuning circuit connecting the arm with a common feeding point associated to the high frequency circuitry.

8. The mobile terminal of claim 6, wherein the switching or tuning circuit comprises at least one of an inductor arrangement and a capacitor arrangement having a tunable or switchable effective inductance or capacity, wherein at least two inductors are selectively connectable in a series connection by a switch arrangement or at least two capacitors are selectively connectable in a parallel connection by a switch arrangement or at least one capacitor has a tunable capacity.

9. The mobile terminal of claim 3, wherein said casing comprises a first body and a second body, each body having a conducting chassis part and electronic part, the mobile terminal further comprising a relative movement mechanism linking the first body and the second body and allowing a relative movement between the two bodies at least between a first operational relative position and a second operational relative position and an electrical connection arrangement providing at least one of signal and data and control and high frequency and grounding lines between the two bodies.

10. The mobile terminal of claim 9, wherein the relative movement mechanism comprises one hinge effective between the two bodies, allowing a swiveling or folding movement of the two bodies with respect to each other between a closed operational relative position in which two surfaces of the two bodies face and cover each other and an open operational relative position in which the two surfaces both are uncovered.

11. The mobile terminal of claim 4, wherein said arm or said two arms have a width in a direction orthogonal to a surface of said conducting chassis part within the periphery thereof exceeding a thickness of said conducting chassis part and covering said chassis part edge in outward direction.

12. The mobile terminal of claim 4, wherein at least one pair of arms of said antenna element or two different antenna elements extends outwardly of the periphery along said at least one chassis part edge, a first arm of said pair being displaced with respect to said conducting chassis part in a direction orthogonal to a surface of said conducting chassis part within the periphery thereof and a second arm being displaced with respect to said conducting chassis part and with respect said first arm in said direction orthogonal to a surface of said conducting chassis, so that the conducting chassis part is located between the first and second arm, or when the first and second body are provided, being displaced with respect to the other conducting chassis part in a direction orthogonal to a surface of said other conducting chassis part within the periphery thereof.

13. The mobile terminal of claim 3, wherein at least one pair of shorter arms each having an effective electrical length shorter than a quarter wavelength at said resonance frequency and at least one pair of longer arms each having an effective electrical length longer than said quarter wavelength are provided, so that said high frequency resonance is obtained.

14. The mobile terminal of claim 13, wherein in case that the first and second body are provided only one of the two bodies is provided with at least one antenna element.

15. The mobile terminal of claim 13, wherein in case that the first and second body are provided both of the two bodies are provided with at least one respective antenna element.

16. The mobile terminal of claim 9, wherein in one of said operational relative positions the two conducting chassis parts are located side by side between the first and second arm and in another of said operational relative positions the two conducting chassis with a respective of the first and second arm are located apart.

17. An apparatus, comprising:

a casing with at least one body having an electronic part; and an antenna arrangement having at least one antenna element provided within said at least one body of said casing in a defined spatial relation to a conducting chassis part of said at least one body allowing a high frequency interaction between the antenna arrangement and the conducting chassis part, said antenna arrangement together with associated high frequency circuitry operative to receive and transmit wireless signals in at least one frequency band, said conducting chassis part limited by a periphery of the conducting chassis part formed by at least one chassis part edge;

wherein said antenna element having at least one arm that extends outwardly of said periphery along said at least one chassis part edge for promoting said high frequency interaction, and said antenna arrangement has at least two arms of different length which are provided by the same antenna element or at least two different antenna elements, said arms to extend in different or opposed directions outwardly of said periphery along at least one chassis part edge.

18. The mobile terminal of claim 17, wherein a shorter arm of said two arms has an effective electrical length shorter than a quarter wavelength at a resonance frequency within a particular predetermined frequency band and a longer arm of said two arms has an effective electrical length longer than a quarter wavelength at said resonance frequency, so that a high frequency resonance is obtained for at least one of receiving or transmitting wireless signals within a resonance bandwidth associated to the high frequency resonance.

* * * * *

UNITED STATES PATENT AND TRADEMARK OFFICE

CERTIFICATE OF CORRECTION

PATENT NO. : 8,432,320 B2
APPLICATION NO. : 12/296335
DATED : April 30, 2013
INVENTOR(S) : Ole Jagielski et al.

It is certified that error appears in the above-identified patent and that said Letters Patent is hereby corrected as shown below:

In the Claims

In column 20, line 45, in Claim 18, delete “mobile terminal” and insert -- apparatus --, therefor.

Signed and Sealed this
Tenth Day of September, 2013

Teresa Stanek Rea
*Acting Director of the United States Patent and Trademark Office*